US011352986B2

(12) United States Patent
McConville et al.

(10) Patent No.: US 11,352,986 B2
(45) Date of Patent: Jun. 7, 2022

(54) SYSTEMS AND METHODS FOR A VALVE IN A DUAL-CORE EGR COOLER

(71) Applicant: Ford Global Technologies, LLC, Dearborn, MI (US)

(72) Inventors: Gregory McConville, Ann Arbor, MI (US); Daniel Joseph Styles, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/074,479

(22) Filed: Oct. 19, 2020

(65) Prior Publication Data

US 2022/0120243 A1 Apr. 21, 2022

(51) Int. Cl.

| | |
|---|---|
| ***F02M 26/33*** | (2016.01) |
| ***F02M 26/24*** | (2016.01) |
| ***F02M 26/26*** | (2016.01) |
| ***F28D 7/16*** | (2006.01) |

(52) U.S. Cl.

CPC ..... *F02M 26/33* (2016.02); *F02M 26/24* (2016.02); *F02M 26/26* (2016.02); *F28D 7/1638* (2013.01); *F28D 7/1676* (2013.01)

(58) Field of Classification Search

CPC ..... F02M 26/33; F02M 26/24; F02M 26/26; F28D 7/1676; F28D 7/1638

USPC ..... 701/108; 123/568.12

See application file for complete search history.

(56) References Cited

U.S. PATENT DOCUMENTS

| | | | | |
|---|---|---|---|---|
| 7,213,587 | B2 * | 5/2007 | Rutten | F02M 26/26 123/568.24 |
| 7,950,376 | B2 * | 5/2011 | Rollet | F02M 26/30 123/568.12 |
| 2007/0017489 | A1 * | 1/2007 | Kuroki | F02M 26/25 123/568.12 |
| 2009/0260604 | A1 * | 10/2009 | Castano Gonzalez | F28D 7/1676 123/568.12 |
| 2009/0313992 | A1 * | 12/2009 | Pearson | F02M 26/50 60/605.2 |
| 2010/0288955 | A1 * | 11/2010 | Bonanno | F16K 11/0853 251/209 |
| 2018/0087449 | A1 * | 3/2018 | Kollar | F02B 29/0418 |

FOREIGN PATENT DOCUMENTS

| | | | | |
|---|---|---|---|---|
| DE | 19936241 | A1 * | 2/2001 | F28F 1/42 |

* cited by examiner

*Primary Examiner* — Mahmoud Gimie
(74) *Attorney, Agent, or Firm* — Geoffrey Brumbaugh; McCoy Russell LLP

(57) ABSTRACT

Methods and systems are provided for directing the flow of recirculated exhaust gas (EGR) delivered to an EGR cooler. In one example, a method includes flowing EGR through an EGR cooler positioned in an EGR passage, the EGR cooler comprising a bypass passage, a first cooler core flow path, and a second cooler core flow path, and adjusting a valve of the EGR cooler to selectively block flow of the EGR through the bypass passage, the first cooler core flow path, and the second cooler core flow path. In this way, fouling of the EGR cooler may be reduced.

19 Claims, 10 Drawing Sheets

SYSTEMS AND METHODS FOR A VALVE IN A DUAL-CORE EGR COOLER

FIELD

The present description relates generally to methods and systems for controlling a flow of recirculating exhaust gas through a heat exchanger, and more particularly to methods and systems for a rotary valve controlling the flow of recirculating exhaust gas through a dual-core heat exchanger including a bypass.

BACKGROUND/SUMMARY

Vehicle engine systems may utilize an external exhaust gas recirculation (EGR) system to reduce $NO_x$ emissions and increase engine efficiency. For example, the external EGR system may couple an engine exhaust manifold to an engine intake manifold via an EGR passage. An EGR valve disposed within the EGR passage may be controlled to achieve a desired intake air dilution for the given engine operating conditions (e.g., engine speed, engine load, engine temperature, and fuel injection parameters such as requested fuel injection amount) to maintain desirable combustion stability while providing emissions and fuel economy benefits. Further, the efficiency of the NOx reduction may be further increased by cooling the EGR prior to mixing with the intake air via a heat exchanger positioned in the EGR passage, referred to as an EGR cooler. However, because the EGR passage is frequently coupled to the exhaust manifold or exhaust passage upstream of any catalysts or emission control devices, the EGR that flows through the EGR cooler may include hydrocarbons, particulate matter, and other emissions that may lead to deposition within the EGR cooler, referred to as fouling. EGR cooler fouling may eventually block EGR flow through the EGR cooler, increasing engine backpressure and lowering desired EGR flow, each of which may negatively impact engine performance and/or emissions.

Other attempts to reduce EGR cooler fouling include positioning a catalyst, such as a hydrocarbon trap and/or particulate filter, upstream of the EGR cooler. One example approach is shown by Styles et al. in U.S. Pat. No. 7,461,641. Therein, a dedicated EGR catalyst (which may be a hydrocarbon trap or particulate filter) is positioned upstream of an EGR cooler. The inclusion of the dedicated EGR catalyst in the EGR system may allow for an additional EGR cooler core to be placed in series with an initial EGR cooler core. The two EGR cooler cores may provide additional cooling of the EGR, while the dedicated EGR catalyst prevents fouling of the EGR cooler cores that may otherwise occur, particularly in the second EGR cooler core where low EGR temperatures are attained.

However, the inventors herein have recognized that a dedicated EGR catalyst is expensive and increases the packaging space of the EGR system, which may make the inclusion of the EGR catalyst impractical in some engine systems. Further, while the system shown by Styles et al. includes a bypass passage controlled by a bypass valve that allows EGR to bypass the EGR cooler cores under some conditions (e.g., engine warm-up or when fouling is still predicted to occur), the bypass valve configuration may still allow at least some flow through the EGR cooler cores when the EGR is intended to bypass the EGR cooler cores, which may cause fouling over time.

In one example, the issues described above may be addressed by a method including flowing EGR through an EGR cooler positioned in an EGR passage, the EGR cooler comprising a bypass passage, a first cooler core flow path, and a second cooler core flow path, and adjusting a valve to selectively block or allow flow of EGR though the bypass passage, the first cooler core flow path, and the second cooler core flow path. In this way, cooling of the EGR may be achieved when demanded, while minimizing EGR cooler fouling, by routing EGR through the bypass passage only, through the bypass passage and one of the cooler core flow paths, or through both of the cooler core flow paths. For example, during conditions where EGR cooler fouling is likely (such as lower EGR flow and/or lower engine load conditions), all EGR may be directed through one of the cooler core flow paths, which may increase the velocity of the EGR and thus reduce fouling. During conditions where EGR cooler fouling is less likely (such as higher EGR flow and/or higher engine load conditions), the EGR may be split between the two cooler core flow paths, thereby providing increased EGR cooling and reduced pressure drop across the EGR cooler.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
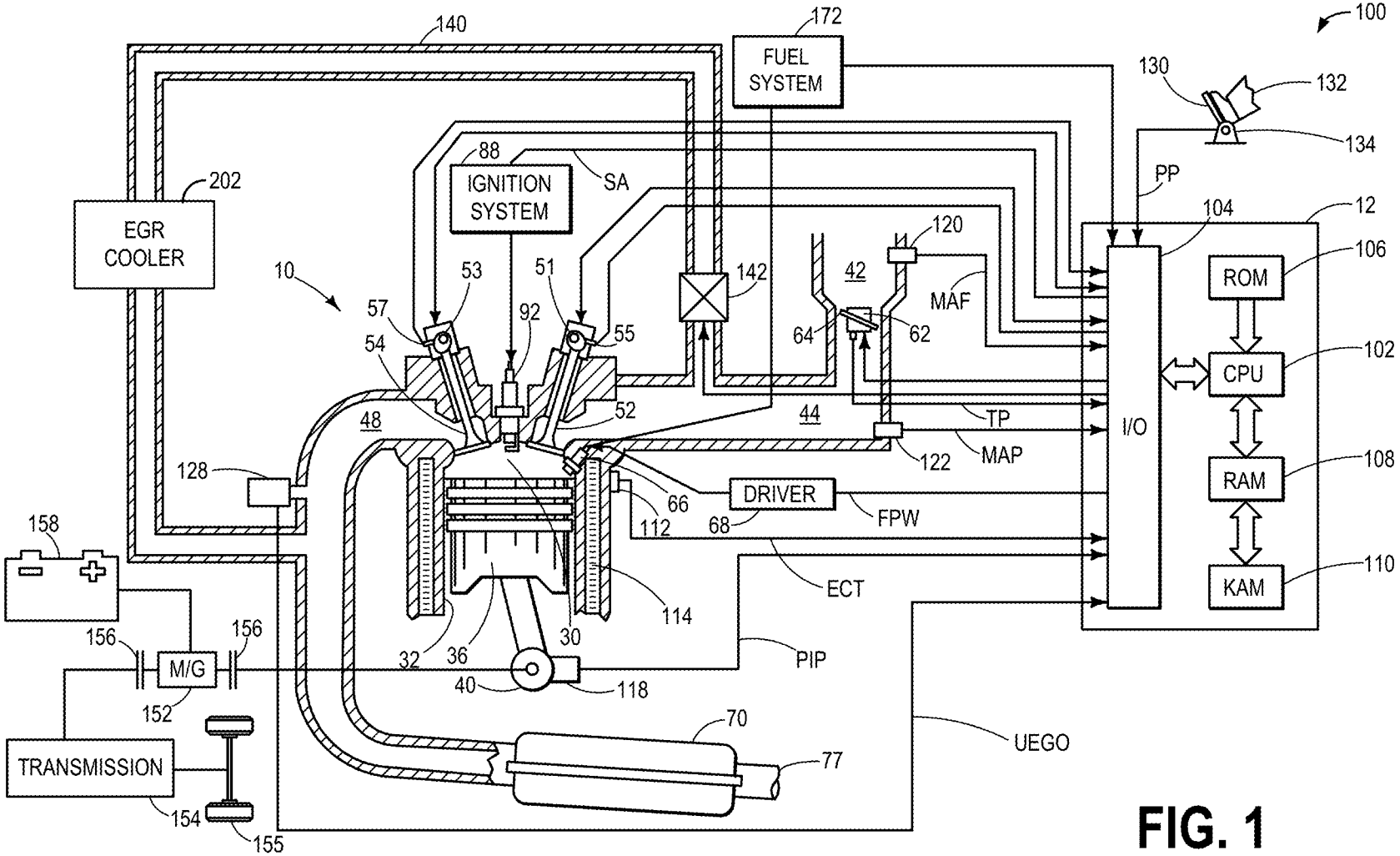
FIG. 1 shows a schematic depiction of an example vehicle system including an EGR cooler positioned in an EGR passage.
Figure 2:
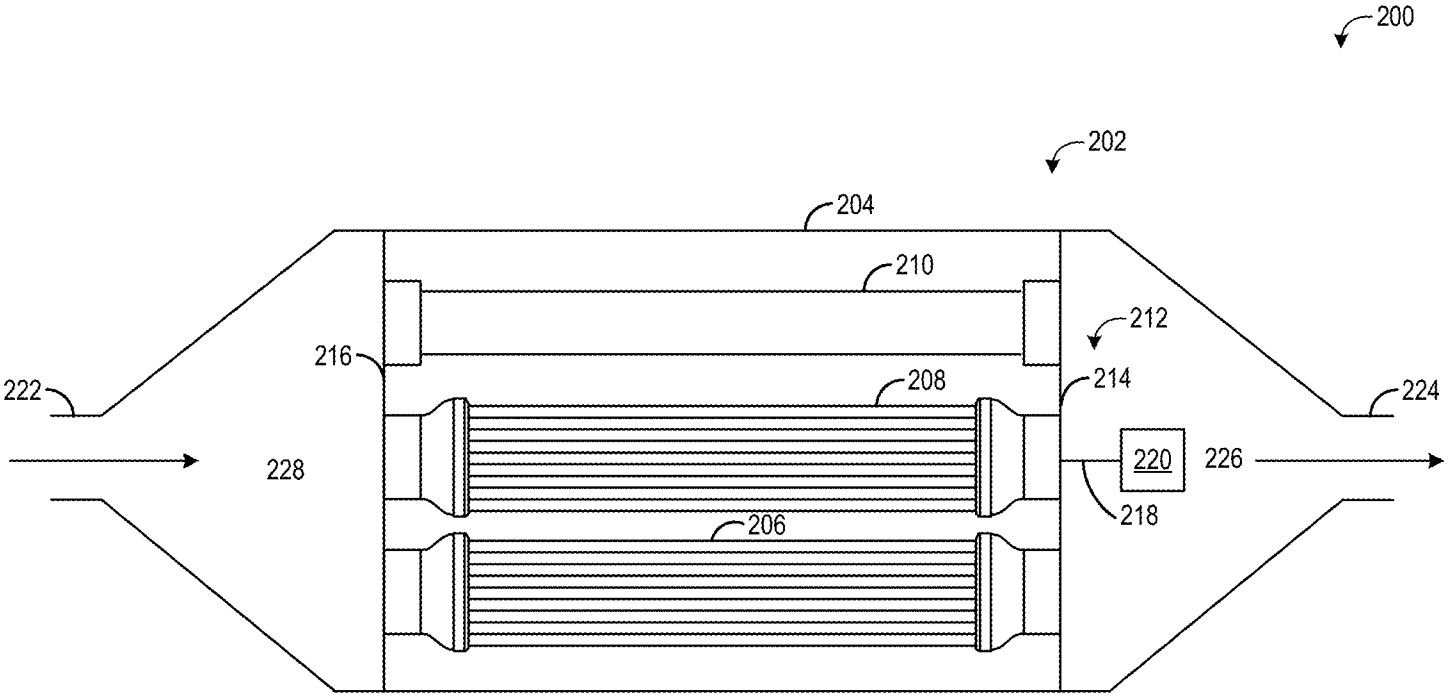
FIG. 2 schematically shows the EGR cooler of FIG. 1, including two cooler cores, a bypass passage, and a rotary valve.
Figure 4:
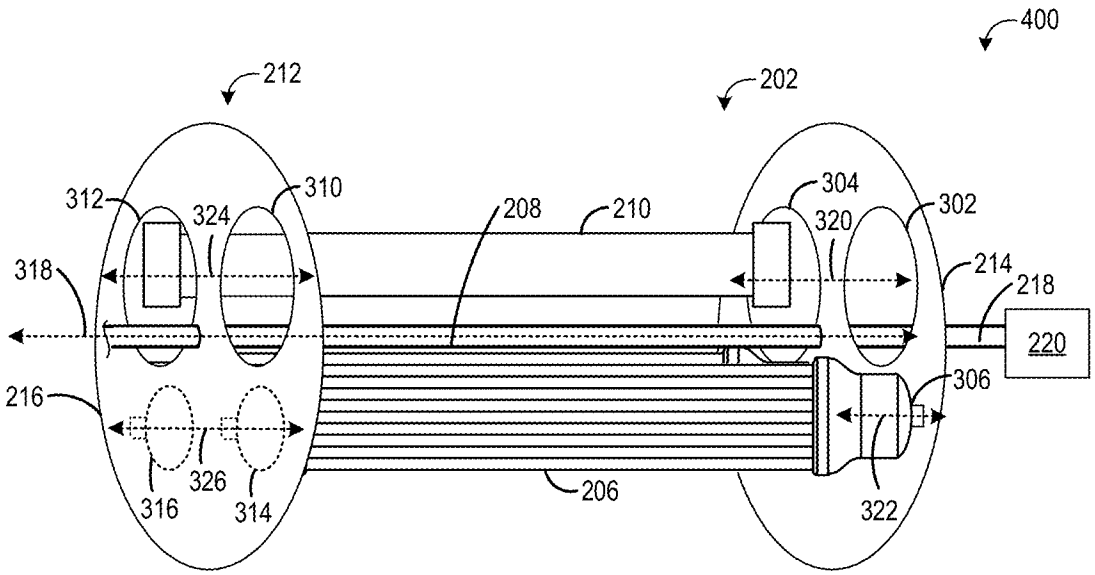
FIG. 4 schematically shows the EGR cooler of FIG. 2 with the rotary valve in a second position.

The following description relates to systems and methods for modulating flow of exhaust gas through an exhaust gas recirculation (EGR) system including a cooling system (e.g., EGR cooler) in a vehicle, such as the hybrid vehicle shown in FIG. 1. The EGR flow may be modulated through and/or around two EGR cooler cores or two flow paths of an EGR cooler core of the EGR cooler, as shown in FIG. 2, based on EGR cooling demand (which may be based on vehicle load, EGR valve position, requested and actual EGR rate and amount, exhaust gas temperature, etc.) and actual or expected fouling conditions of the EGR cooler. To modulate the flow, the EGR cooler may include a rotary valve that may facilitate or block flow through a bypass passage and two EGR cooler core flow paths, as shown in FIGS. 4-5B. The rotary valve may include two end plates that are rotated in tandem via a motor-driven shaft, where each end plate includes two openings and two poppet valves. When aligned with a passage of the EGR cooler (e.g., the bypass passage or one of the EGR cooler core paths), a poppet valve (in one example) may seal the passage, thus blocking flow, as shown in FIG. 6.

Figure 7A:
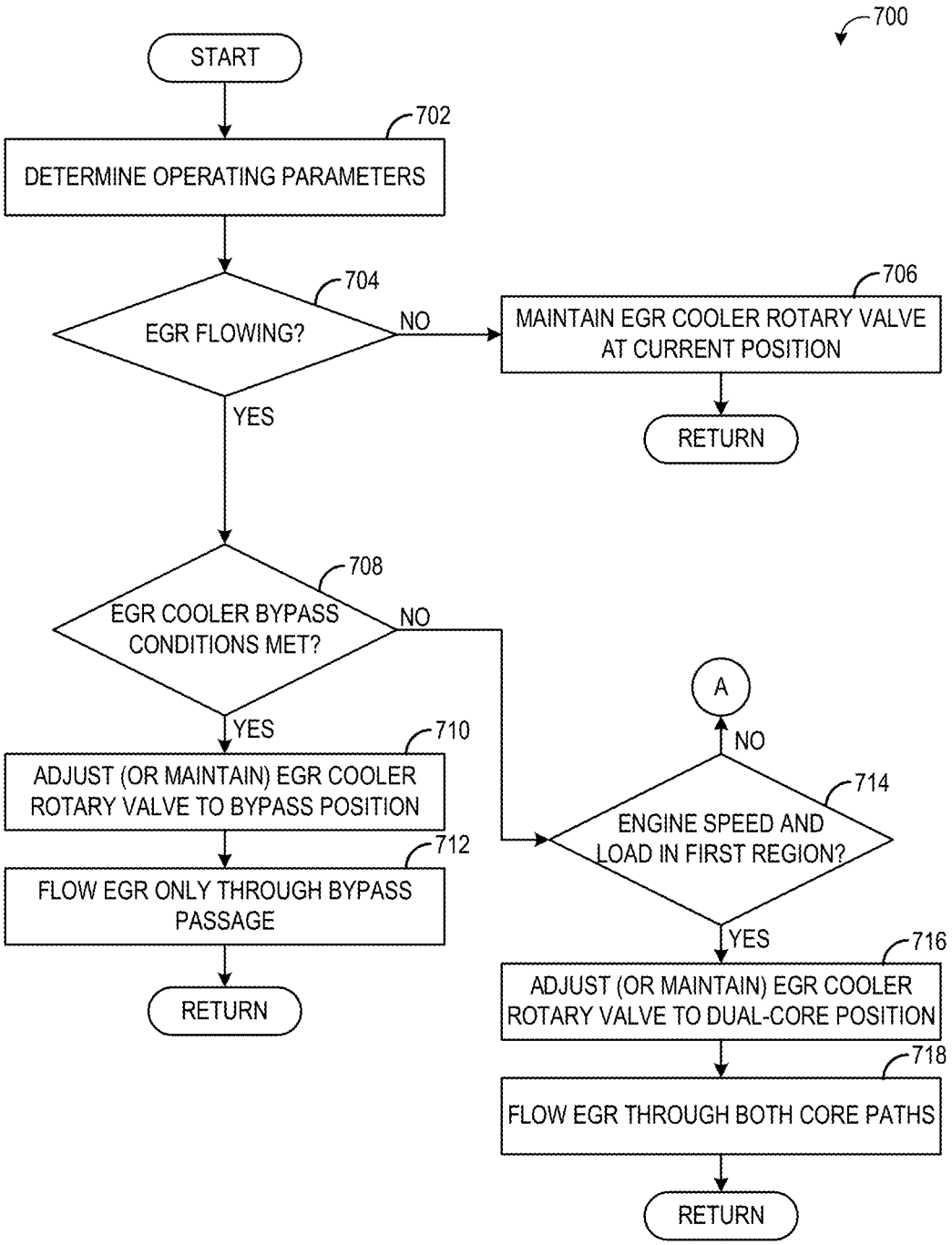
FIGS. 7A and 7B show a flow chart illustrating an example method for controlling EGR flow in an EGR cooler.
Figure 7B:
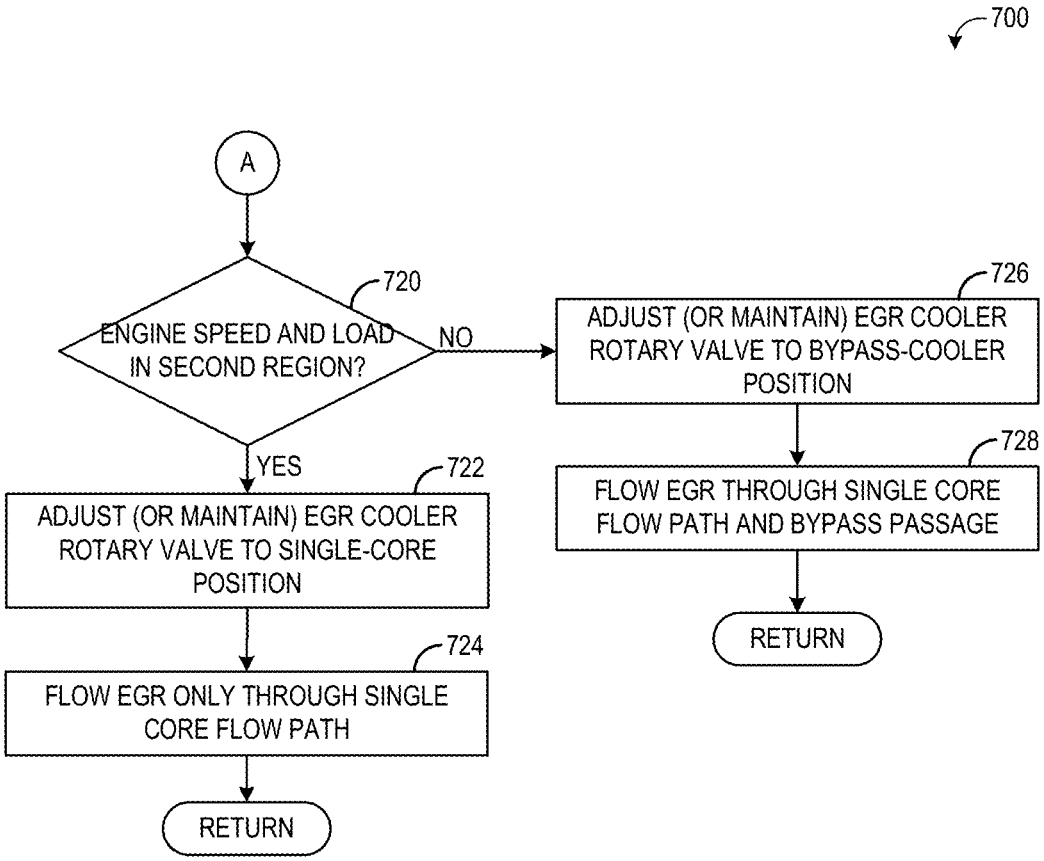
Figure 8:
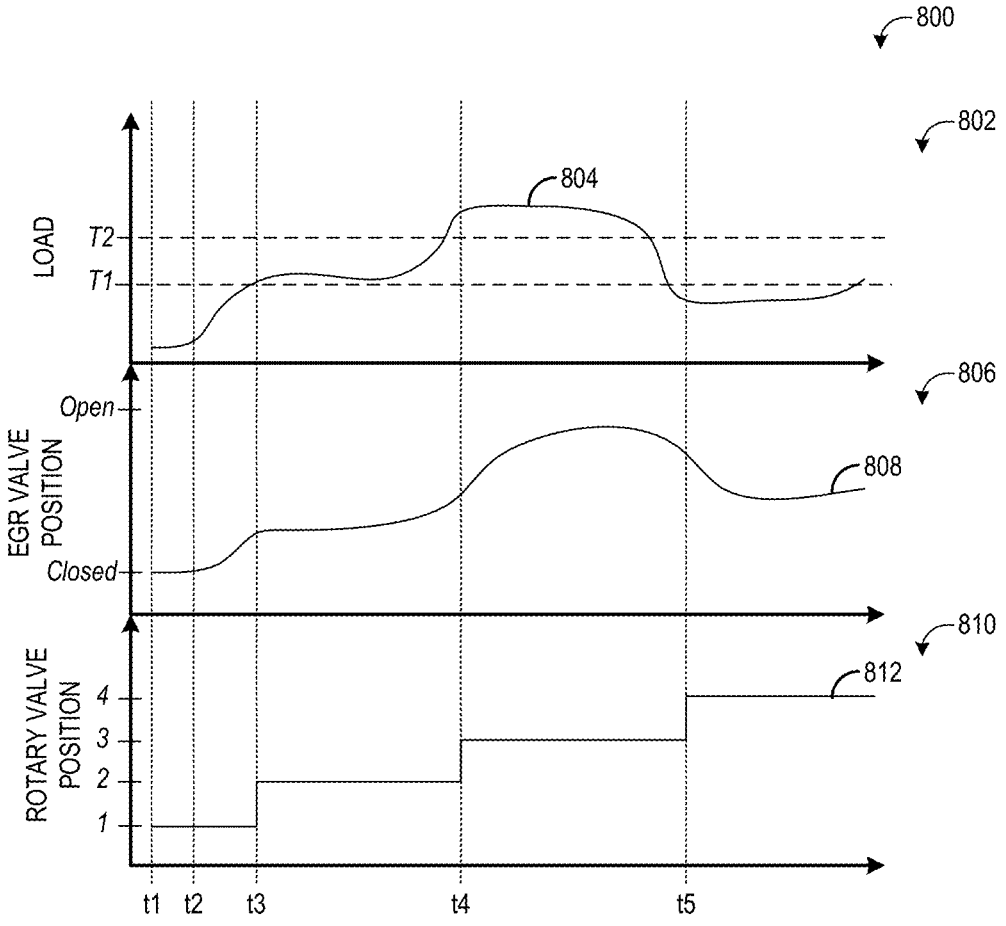
FIG. 8 is a timeline illustrating operating parameters of interest during execution of the method of FIGS. 7A and 7B.

The dual-core EGR cooler having a bypass passage and being controlled by the rotary valve may allow for bypassing both EGR cooler core flow paths, EGR flow through only one or through both EGR cooler core paths, or EGR flow through one cooler core path and the bypass passage, based on EGR flow and EGR cooler demands, as shown by the method of FIGS. 7A and 7B and the engine operating plots of FIG. 8.

The EGR cooler including the rotary valve described herein may provide several advantages. The inclusion of two smaller EGR cooler core paths rather than a single, larger EGR cooler core with a single flow path may reduce EGR cooler fouling, as EGR flow may be limited to only one EGR cooler core path during low flow conditions, which may maintain a relatively high flow rate through the EGR cooler core. During low EGR cooling demand conditions (e.g., engine warm-up) and low EGR flow conditions, flow through one or both of the EGR cooler core paths may be blocked by the rotary valve. The rotary valve may seal the EGR cooler cores on both the upstream and the downstream ends, which may prevent inadvertent admission of EGR into the EGR cooler cores, further lowering EGR cooler fouling. Additionally, the rotary valve may allow for a partial EGR cooler bypass, where some EGR flows through one of the EGR cooler core paths and some EGR bypasses the EGR cooler core paths, which may help facilitate flow during low differential pressure conditions.

FIG. 1 illustrates a schematic diagram of a vehicle system 100 showing one cylinder of a multi-cylinder engine 10, which may be included in a propulsion system of a vehicle. Engine 10 may be controlled at least partially by a control system, including a controller 12, and by input from a vehicle operator 132 via an input device 130. In this example, input device 130 includes an accelerator pedal and a pedal position sensor 134 for generating a proportional pedal position signal PP. A combustion chamber (e.g., cylinder) 30 of engine 10 may include combustion chamber walls 32 with a piston 36 positioned therein. Piston 36 may be coupled to a crankshaft 40 so that reciprocating motion of the piston is translated into rotational motion of the crankshaft. Crankshaft 40 may be coupled to at least one drive wheel of the vehicle via an intermediate transmission system 154. Further, a starter motor may be coupled to crankshaft 40 via a flywheel to enable a starting operation of engine 10.

Combustion chamber 30 and the rest of the cylinders of engine 10 may receive intake air from an intake manifold 44 via an intake passage 42 and may exhaust combustion gases via an exhaust passage 48. Intake manifold 44 and exhaust passage 48 can selectively communicate with combustion chamber 30 via an intake valve 52 and an exhaust valve 54, respectively. In some embodiments, combustion chamber 30 may include two or more intake valves and/or two or more exhaust valves. In this example, intake valve 52 may be controlled by controller 12 by cam actuation via a cam actuation system 51. Similarly, exhaust valve 54 may be controlled by controller 12 via a cam actuation system 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by valve position sensors (not shown) and/or camshaft position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation, including CPS and/or VCT systems. In still other embodiments, the intake and exhaust valves may be controlled by a common valve actuator or actuation system or a variable valve timing actuator or actuation system.

In some embodiments, each cylinder of engine 10 may include a spark plug 92 for initiating combustion. An ignition system 88 can provide an ignition spark to combustion chamber 30 via spark plug 92 in response to a spark advance signal SA from controller 12, under select operating modes. Although spark ignition components are shown, in some embodiments, combustion chamber 30 or one or more other combustion chambers of engine 10 may be operated in a compression ignition mode, with or without an ignition spark.

In some embodiments, each cylinder of engine 10 may be configured with one or more fuel injectors for providing fuel thereto. As a non-limiting example, cylinder 30 is shown including one fuel injector 66. Fuel injector 66 is shown coupled directly to combustion chamber 30 for injecting fuel directly therein in proportion to the pulse width of a signal FPW received from controller 12 via an electronic driver 68. In this manner, fuel injector 66 provides what is known as direct injection (hereafter also referred to as "DI") of fuel into combustion chamber 30. While FIG. 1 shows injector 66 as a side injector, it may also be located overhead of the piston, such as near the position of spark plug 92. Such a position may increase mixing and combustion when operating the engine with an alcohol-based fuel due to the lower volatility of some alcohol-based fuels. In some applications, the injector may be located in place of the spark plug and deliver diesel fuel. Alternatively, the injector may be located overhead and near the intake valve to increase mixing. In an alternate embodiment, injector 66 may be a port injector providing fuel into the intake port upstream of cylinder 30.

Fuel may be delivered to fuel injector 66 from a high pressure fuel system 172 including fuel tanks, fuel pumps, and a fuel rail. Alternatively, fuel may be delivered by a single stage fuel pump at a lower pressure, in which case the timing of the direct fuel injection may be more limited during the compression stroke than if a high pressure fuel system is used. Further, while not shown, the fuel tanks may have a pressure transducer providing a signal to controller 12. Fuel tanks in fuel system 172 may hold fuel with different fuel qualities, such as different fuel compositions. These differences may include different alcohol content, different octane, different heptane, different heat of vaporizations, different fuel blends, and/or combinations thereof, etc.

Continuing with FIG. 1, intake passage 42 may include a throttle 62 having a throttle plate 64 and a throttle position sensor. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30, among other engine cylinders. The position of throttle plate 64 may be provided to controller 12 by the throttle position sensor via a throttle position signal TP. Intake passage 42 may include a mass air flow (MAF) sensor 120 and a manifold absolute pressure (MAP) sensor 122 for providing respective signals MAF and MAP to controller 12.

An exhaust gas sensor 128 is shown coupled to exhaust passage 48 upstream of an emission control device 70. Upstream exhaust gas sensor 128 may be any suitable sensor for providing an indication of exhaust gas air-fuel ratio, such as a linear wideband oxygen sensor or UEGO (universal or wide-range exhaust gas oxygen), a two-state narrowband oxygen sensor or EGO, a HEGO (heated EGO), a $NO_x$ sensor, an HC sensor, or a CO sensor. In the example of FIG. 1, exhaust gas sensor 128 is shown as a UEGO sensor, configured to output a voltage signal UEGO to controller 12 corresponding to an amount of oxygen in the exhaust gas. Controller 12 may use the output to determine the exhaust gas air-fuel ratio (AFR).

Emission control device 70 is shown arranged along exhaust passage 48 downstream of exhaust gas sensor 128. Emission control device 70 may be a three-way catalyst (TWC) configured to reduce $NO_x$ and oxidize CO and unburnt hydrocarbons. In some embodiments, emission control device 70 may be a lean $NO_x$ trap, a particulate filter, various other emission control devices, or combinations thereof. In some examples, one or more additional emission control devices may be coupled to exhaust passage 48. Further, in some examples, one or more additional exhaust gas sensors may be coupled to exhaust passage 48 downstream of emission control device 70 to indicate an AFR of the exhaust gas after passing through emission control device 70 and before exiting to the atmosphere through tailpipe 77.

As shown in FIG. 1, vehicle system 100 may include an external exhaust gas recirculation (EGR) system to route a desired portion of exhaust gas from exhaust passage 48 to intake manifold 44 via an EGR passage 140. The amount of EGR provided to intake manifold 44 may be varied by adjusting a position of an EGR valve 142 disposed within EGR passage 140. For example, controller 12 may be configured to actuate and adjust a position of EGR valve 142 in order to control an amount of EGR flow through EGR passage 140. In the example of FIG. 1, EGR valve 142 is positioned by an incorporated stepper motor. The stepper motor is actuated by controller 12 to adjust the position of EGR valve 142 through a range of discreet steps (e.g., 52 steps), for example. However, in other examples, EGR valve 142 may be a vacuum actuated valve, an electronically activated solenoid valve, direct current motor with position feedback, or other type of flow control valve. When EGR valve 142 is in a closed position, no exhaust gases may flow from exhaust passage 48 to intake manifold 44. When EGR valve 142 is in an open position, exhaust gases may flow from exhaust passage 48 to intake manifold 44 via EGR passage 140. Controller 12 may additionally adjust EGR valve 142 into a plurality of positions between fully open and fully closed. As the opening of EGR valve 142 is increased, the amount of EGR provided to intake manifold 44 increases, and as the opening of EGR valve 142 is decreased, the amount of EGR provided to intake manifold 44 decreases.

Under some conditions, the EGR system may be used to regulate the temperature of the air and fuel mixture within the combustion chamber. Further, EGR may be desired to attain a desired engine dilution, thereby improving fuel efficiency and emissions quality, in particular, emissions of nitrogen oxides. For example, EGR may be requested at low to mid engine loads. Additionally, EGR may be desired after emission control device 70 has attained its light-off temperature. An amount of EGR requested may be based on engine operating conditions, including engine load (as estimated via pedal position sensor 134), engine speed (as estimated via a crankshaft position sensor), engine temperature (as estimated via an engine coolant temperature sensor 112), etc. For example, controller 12 may refer to a look-up table having the engine speed and load as the input, and output a desired amount of EGR corresponding to the input engine speed-load. In another example, controller 12 may determine the desired amount of EGR (e.g., desired EGR flow rate) through logic rules that directly take into account parameters such as engine load, engine speed, engine temperature, etc. In still other examples, controller 12 may rely on a model that correlates a change in engine load with a change in a dilution requirement, and further correlates the change in the dilution requirement with a change in the amount of EGR requested. For example, as the engine load increases from a low load to a mid load, the amount of EGR requested may increase, and then as the engine load increases from a mid load to a high load, the amount of EGR requested may decrease. Controller 12 may further determine the amount of EGR requested by taking into account a best fuel economy mapping for a desired dilution rate. After determining the amount of EGR requested, controller 12 may refer to a look-up table having the requested amount of EGR as the input, and a signal corresponding to a degree of opening to apply to the EGR valve (e.g., as sent to the stepper motor) as the output.

The EGR system may additionally include an EGR cooler 202, through which recirculated exhaust gas may flow. Exhaust gas may flow through the EGR cooler 202 and interact with one or more cooler cores, which may lower the exhaust gas temperature. In some examples, the EGR cooler 202 may have two cooler cores. In other examples, the EGR cooler 202 may have one cooler core that includes two separate flow paths (e.g., an inlet of the cooler core may be bifurcated such that part of the inlet leads to a first set of cooling channels and another part of the inlet leads to a second set of cooling channels). The EGR cooler 202 may comprise a bypass passage through which exhaust gas may flow when requested by the controller 12, bypassing the cooler core(s). The EGR cooler may additionally comprise a valve which may modulate the flow of exhaust gas through the cooler, allowing the exhaust gas to pass through the EGR cooler core(s) and/or the bypass passage as needed. For example, the entirety of the recirculated exhaust gas may flow through the bypass passage when the volume of EGR is low and/or when a threshold temperature, such as the emission control device 70 light off temperature, has not been met, and cooling of the recirculated exhaust gas may be undesirable. In still another example, the exhaust gas may flow through both EGR cooler core flow paths, through only one EGR cooler core flow path, or the exhaust gas may flow through one EGR cooler core flow path and the bypass passage, for example. In some examples, controller 12 may send signals to an actuator of the valve which may adjust the position of the valve in order to modulate the flow of exhaust gas within the EGR cooler 202. Additional details about the EGR cooler and the valve are provided below with respect to FIGS. 2-8.

In some examples, vehicle system 100 may include a turbocharger (not shown) including a turbine positioned in exhaust passage 48 and a compressor positioned in intake passage 44, with the turbine coupled to the compressor via a shaft. Exhaust gas may spin the turbine which in turn spins the compressor, thereby compressing intake air provided to the engine. The turbine may be positioned upstream of the junction of exhaust passage 48 and EGR passage 140, thereby providing what is referred to as low-pressure EGR through EGR passage 48. In other examples, the turbine may be positioned downstream of the junction of exhaust passage 48 and EGR passage 140, thereby providing what is referred to as high-pressure EGR through EGR passage 48. In still further examples, both low-pressure and high-pressure EGR may be provided (necessitating an additional EGR passage).

Controller 12 is shown in FIG. 1 as a microcomputer, including a microprocessor unit 102, input/output ports 104, an electronic storage medium for executable programs and calibration values shown as read-only memory chip 106 in this particular example, random access memory 108, keep alive memory 110, and a data bus. Storage medium read-only memory 106 can be programmed with computer readable data representing non-transitory instructions executable by processor 102 for performing the methods described below, such as the method described with respect to FIG. 2, as well as other variants that are anticipated but not specifically listed.

Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to a cooling sleeve 114; a profile ignition pickup signal (PIP) from a Hall effect sensor 118 (or other type) coupled to crankshaft 40; throttle position (TP) from the throttle position sensor; and absolute manifold pressure (MAP) signal from MAP sensor 122. Engine speed, RPM, may be generated by controller 12 from signal PIP. Controller 12 receives signals from the various sensors of FIG. 1 and employs the various actuators of FIG. 1, such as EGR valve 142 and fuel injector 66, to adjust engine operation based on the received signals and instructions stored on a memory of the controller. For example, adjusting a position of EGR valve 142 may include sending a signal to the stepper motor of EGR valve 142 to adjust the EGR valve position (e.g., an opening of EGR valve 142).

In some examples, vehicle system 100 may be a hybrid vehicle with multiple sources of torque available to one or more vehicle wheels. For example, vehicle system 100 may include engine 10 and an electric machine 152, which may be a motor or a motor/generator. In other examples, vehicle 100 is a conventional vehicle with only an engine. In the example shown, vehicle system 100 includes engine 10 and electric machine 152. Crankshaft 40 of engine 10 and electric machine 152 are connected via transmission 154 to vehicle wheels 155 when one or more clutches 156 are engaged. In the depicted example, a first clutch 156 is provided between crankshaft 40 and electric machine 152, and a second clutch 156 is provided between electric machine 152 and transmission 154. Controller 12 may send a signal to an actuator of each clutch 156 to engage or disengage the clutch, so as to connect or disconnect crankshaft 40 from transmission 154 and the components connected thereto, and/or connect or disconnect electric machine 152 from transmission 154 and the components connected thereto. Transmission 154 may be a gearbox, a planetary gear system, or another type of transmission. The powertrain may be configured in various manners, including as a parallel, a series, or a series-parallel hybrid vehicle.

Electric machine 152 receives electrical power from a traction battery 158 to provide torque to vehicle wheels 155. Electric machine 152 may also be operated as a generator to provide electrical power to charge battery 158, for example during a braking operation.

As described above, FIG. 1 shows only one cylinder of a multi-cylinder engine, and each cylinder may similarly include its own set of intake/exhaust valves, fuel injector, spark plug, etc.

As mentioned above, an EGR system may recirculate a portion of exhaust gas to an intake manifold of an engine in order to provide a desired engine dilution. Recirculated exhaust gas may increase fuel economy and reduce emissions, for example. Because the recirculated exhaust gas is typically at relatively high temperature, the EGR system may include an EGR cooler to reduce the temperature of the EGR before admission to the engine, which may reduce engine misfire and other issues. However, in some engines, particularly engine configurations where the EGR is sourced before the aftertreatment system, compounds carried with the EGR have the potential to deposit in the EGR cooler. This fouling of the EGR cooler reduces the cooling effectiveness, increases pressure drop across the EGR cooler, and can lead to plugging of the cooler. Deposit formation is a function of coolant temperature, EGR temperature, and EGR flow velocity through the EGR cooler. While some EGR cooler configurations include a bypass circuit to prevent fouling under some conditions, flow through the bypass circuit limits the ability to cool the EGR. Additionally, in some configurations, while the bypass circuit is open, the heat exchanger component of the EGR cooler (referred to as the cooler core) is not completely isolated from the EGR gasses, and pulsations can cause deposits to form in the cooler core.

Thus, according to embodiments disclosed herein, an EGR cooler, such as EGR cooler 202 described above, may include three flow paths which can be selected for different operating conditions. Two paths include heat exchangers (e.g., cooler cores) for cooling the EGR, and one path bypasses the heat exchangers. The EGR cooler is thus configured to operate in four modes: 1) only the bypass is open; 2) the bypass and one heat exchanger are open; 3) only one heat exchanger is open; and 4) the two heat exchangers are open and the bypass is closed. An actuator moves a four position valve assembly to select between these modes. The actuator and valve assembly may be referred to herein as a rotary valve. Compared to prior EGR coolers, the EGR cooler described herein provides two additional modes: 1) bypass and a small cross section of heat exchanger in parallel to allow some cooling with low pressure drop; and 2) all flow through a small cross section of heat exchanger to keep velocity higher and reduce deposit formation. Additionally, the rotary valve described herein positively seals off both ends of the heat exchangers during bypass operation to prevent deposits from forming in the heat exchangers due to pulsation flow.

FIG. 2 shows a schematic view 200 of EGR cooler 202. The flow of exhaust into the EGR cooler 202 may be controlled by an EGR valve, such as EGR valve 142 of FIG. 1, positioned outside of the EGR cooler (e.g., either upstream or downstream of the EGR cooler). The EGR cooler 202 may comprise an EGR cooler housing 204, which may surround at least a portion of the EGR cooler 202. Additional components of the EGR cooler 202 may be packaged within the EGR cooler housing 204, and may include a first EGR cooler core 206, a second EGR cooler core 208, a bypass passage 210, and a rotary valve 212. The first EGR cooler core 206 may comprise an inlet coupled to a plurality of hollow passages, allowing exhaust gas to pass through. The first EGR cooler core 206 may transfer heat from the exhaust gas flowing through the hollow passages to a cooling medium, which in some examples may include a liquid coolant (e.g., from the engine cooling system) flowing through a plurality of cooling medium passages in thermal contact with the hollow, gas-flowing passages. In other examples, the cooling medium may be gas (e.g., ambient air) or another appropriate cooling media. In this way, exhaust gas may enter the first EGR cooler core 206 at a first temperature and exit the first EGR cooler core 206 at a lower temperature. The second EGR cooler core 208 may be similar or identical to the first EGR cooler core 206 (e.g., including an inlet coupled to a plurality of hollow cooling passages through which EGR may flow). Alternately, second EGR cooler core 208 may be larger or smaller than the first cooler core in order to provide the most desirable balance of cooling capacity, flow velocity, and pressure drop under various operating modes. The bypass passage 210 may comprise a hollow passage through which exhaust gas may flow. The bypass passage may not have any cooling elements, such that the exhaust gas may enter the bypass passage at a first temperature and exit at a substantially similar temperature. In other words, the exhaust gas may not be substantially cooled by flowing through the bypass passage. The bypass passage is therefore used in modes of operation in which cooling of the recirculated exhaust gas is not desired.

In some examples, rather than including two separate EGR cooler cores each with a respective inlet and outlet as shown in FIG. 2, EGR cooler 202 may include a single EGR cooler core with two distinct flow paths. For example, the single EGR cooler core may include a first set of cooling passages through which EGR can flow and a second set of cooling passages through which EGR can flow, each housed in the same EGR cooler core. Flow through one or both of the sets of cooling passages may be provided via a bifurcated inlet. In this way, EGR cooler 202 may include two cooler core flow paths, which may include respective flow paths through separate cooler cores, as shown and described, or respective flow paths through a single cooler core.

The flow of exhaust gas through and/or around the EGR cooler cores and through and/or around the bypass passage may be modulated by the action of the rotary valve 212. The rotary valve 212 may comprise a first end plate 214, positioned at the downstream end of the EGR cooler 202, intermediate an EGR cooler outlet 224 and the respective outlets of the first EGR cooler core 206, the second EGR cooler core 208, and the bypass passage 210. The rotary valve 212 may additionally comprise a second end plate 216, positioned at the upstream end of the EGR cooler 202, intermediate an EGR cooler inlet 222 and the respective inlets of the first EGR cooler core 206, the second EGR cooler core 208, and the bypass passage 210. The rotary valve 212 may couple fluidly to the bypass passage 210, the first EGR cooler core 206, and the second EGR cooler core 208.

The first end plate 214 of the rotary valve and the second end plate 216 of the rotary valve may rotate around a shaft 218, which may be located in the center of the rotary valve. The shaft 218 may extend along or parallel to a central longitudinal axis of the EGR cooler 202, in one example. The shaft may be rotationally coupled to a motor 220, which may rotate the shaft 218 and therefore the rotary valve 212 when commanded by a controller, such as controller 12.

Exhaust gas may enter the EGR cooler 202 from the EGR cooler inlet 222, positioned at an upstream end of the EGR cooler 202, and flow into a second EGR chamber 228. The second EGR chamber 228 may be fluidly coupled to all or some of the bypass passage, first EGR cooler core, second EGR cooler core, depending on the position and engagement of the rotary valve 212. The second end plate 216 may either block or allow passage of exhaust gas through the bypass passage or the EGR cooler cores, depending on its position.

A first EGR chamber 226 may be fluidly coupled to all or some of the bypass passage, first EGR cooler core, and second EGR cooler core, depending on the position and engagement of the rotary valve 212. The first end plate 214 may either block or allow passage of exhaust gas through the bypass passage 210 or the EGR cooler cores, depending on its position. The position of the first end plate 214 may correspond to the position of a second end plate 216 (e.g., as the shaft 218 rotates the end plates in tandem), such that when the rotary valve 212 is positioned to block flow through the bypass passage 210, the first EGR cooler core 206, and/or the second EGR cooler core 208, each end of the blocked passage or core is sealed. In this way, the blocked passage or core(s) does not experience inadvertent flow of exhaust during EGR pressure pulsations.

FIG. 2 depicts a schematic view of the EGR cooler in which the bypass passage, the first EGR cooler core, and the second EGR cooler core are arranged laterally and along the same plane. This is not meant to show the actual configuration of the EGR cooler system, but may be altered for clarity. The actual arrangement of the first and second EGR cooler cores, the bypass passage, and the rotary valve may be different than depicted.

Figure 3:
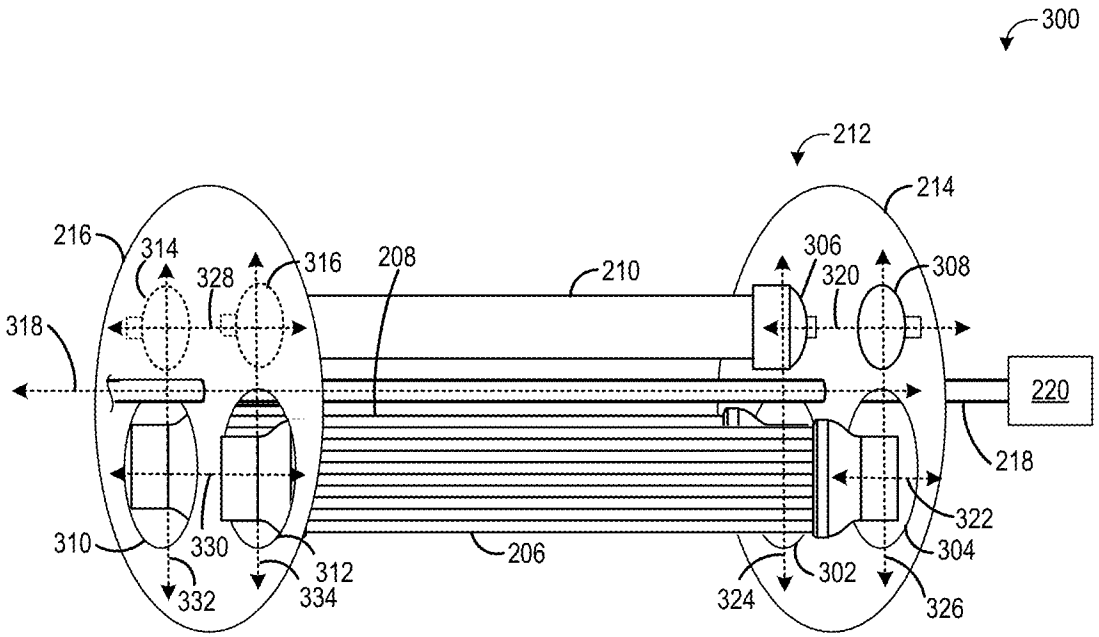
FIG. 3 schematically shows the EGR cooler of FIG. 2 with the rotary valve in a first position.

FIG. 3 shows a schematic view 300 of the EGR cooler 202 with the rotary valve 212 in a dual-cooler position where EGR flow through both EGR cooler cores is enabled. The first end plate 214 includes a first opening 302, a second opening 304, a first poppet valve 306, and a second poppet valve 308. The first poppet valve 306 and the second poppet valve 308 are positioned on an interior side of the first end plate 214, facing into the interior of the EGR cooler 202 (e.g., away from the first chamber 226).

The first poppet valve 306 and the second poppet valve 308 are aligned along a common first axis 320. Likewise, the first opening 302 and the second opening 304 are aligned along a common second axis 322, parallel to the first axis 320. The first opening 302 and the first poppet valve 306 are aligned along a common third axis 324, perpendicular to the first axis 320. The second opening 304 and the second poppet valve 308 are aligned along a common fourth axis 326, parallel to the third axis 324.

The second end plate 216 includes a third opening 310, a fourth opening 312, a third poppet valve 314, and a fourth poppet valve 316. The third poppet valve 314 and the fourth poppet valve 316 of the second end plate 216 are positioned on an interior side of the second end plate 216, facing into the interior of the EGR cooler 202 (e.g., away from the second chamber 228).

The third poppet valve 314 and the fourth poppet valve 316 are aligned along a common fifth axis 328. Likewise, the third opening 310 and the fourth opening 312 of the second end plate are aligned along a common sixth axis 330, parallel to the fifth axis 328. The third opening 310 and the third poppet valve 314 are aligned along a common seventh axis 332, parallel to the third axis 324. The fourth opening 312 and the fourth poppet valve 316 of the second end plate are aligned along a common eighth axis 334, parallel to the seventh axis 332.

In the dual-cooler position shown in FIG. 3, the fourth opening 312 is aligned with the first EGR cooler core 206. The fourth opening 312 is fluidly coupled to the first EGR cooler core 206 such that exhaust gas may flow through the fourth opening 312 of the second end plate into the first EGR cooler core 206. The second opening 304 is aligned with and fluidly connected with the first EGR cooler core 206, such that exhaust gas may flow through the first EGR cooler core 206 and out of the second opening 304.

In the position pictured in FIG. 3, the third opening 310 is aligned with the second EGR cooler core 208. The third opening 310 is fluidly coupled to the second EGR cooler core 208 such that exhaust gas may flow through the third opening 310 into the second EGR cooler core 208. The first opening 302 is aligned with and fluidly connected with the second EGR cooler core 208, such that exhaust gas may flow through the EGR second cooler core 208 and out of the first opening 302.

The third poppet valve 314 seals the bypass passage 210, preventing exhaust gas from flowing into the bypass passage 210. The first poppet valve 306 is similarly sealingly engaged with the bypass passage 210.

The fourth poppet valve 316 and the second poppet valve 308 are not sealing any passage or cooler in the dual-cooler position shown in FIG. 3. This position may be utilized when the flow through the EGR system is high, as the high EGR flow may allow for the EGR to flow through both EGR cooler cores at high velocity, and thus the risk of EGR cooler fouling is low.

Because the bypass passage 210 is sealed from the upstream and downstream ends, substantially no exhaust may enter the bypass passage. Exhaust may flow only through the first EGR cooler core 206 and the second EGR cooler core 208.

FIG. 4 shows a schematic view 400 of the EGR cooler 202 with the rotary valve 212 in a bypass position. For example, the motor 220 may be activated to rotate the shaft 218 by 180° relative to the position shown in FIG. 3, resulting in a corresponding rotation of each of the first end plate 214 and the second end plate 216.

The rotary valve 212 is positioned such that the second opening 304 is aligned with and fluidly coupled to the bypass passage 210 and the fourth opening 312 is aligned with and fluidly coupled to the bypass passage 210. The fluid coupling of the bypass passage 210 with an opening in each of the end plates (e.g., second opening 304 and fourth opening 312) allows exhaust gas to flow through the bypass passage 210. By travelling through the bypass passage 210, the exhaust gas may experience substantially no cooling, and may exit the EGR cooler 202 at substantially the same temperature at which the exhaust gas entered the EGR cooler 202. The rotary valve may be positioned in the bypass passage position during low engine load where EGR flow is relatively low, for example. The bypass position may additionally be used when there is little or no desire for the recirculating exhaust gas to be cooled, such as during start up, or when a temperature of the engine, such as a temperature of the engine 10 and/or the emission control device 70, is below a desired temperature.

In the bypass position shown in FIG. 4, the first opening 302 is in front of the "dead" portion of the EGR cooler, which may be empty space (e.g., lacking a passage and thus having no outlet), and so may not be fluidly coupled to a bypass or an EGR cooler core. The third opening 310 may also not be fluidly coupled to the bypass passage 210 or to either EGR cooler core, in the bypass position.

The first EGR cooler core 206 may be sealed by the first poppet valve 306 and by the third poppet valve 314. The first poppet valve 306, when sealing the outlet of the first EGR cooler core 206, may prevent exhaust gas from passing into or exiting the first EGR cooler core 206 from the downstream first EGR chamber 226, shown in FIG. 2. The third poppet valve 314 of the second end plate may prevent exhaust from flowing into the first EGR cooler core 206 from the upstream second EGR chamber 228 pictured in FIG. 2.

Similarly, the second poppet valve 308 of the first end plate (blocked from view in FIG. 4) may be sealingly engaged with the second EGR cooler core 208, while the fourth poppet valve 316 may be sealingly engaged with the second EGR cooler core 208. The fluid seal of the second and fourth poppet valves may prevent exhaust gas from passing into or out of the second EGR cooler core 208.

When the first EGR cooler core 206 or the second EGR cooler core 208 are blocked by the rotary valve 212 in the bypass position, the exhaust gas may flow entirely through the bypass passage 210. Because the exhaust gas is not flowing through the first EGR cooler core 206 or the second EGR cooler core 208, the exhaust gas may not be substantially cooled during its path through the EGR cooler 202. In other words, the exhaust gas may exit the EGR cooler 202 at substantially the same temperature at which the exhaust gas entered the EGR cooler 202. This maintenance of exhaust gas temperature may be beneficial in increasing the engine 10 and/or emission control device 70 temperature, if desired.

The rotary valve 212 may be rotated to two other positions (e.g., in addition to the illustrated bypass position and dual-core position). The two other positions may include a single cooler position where all EGR flows through one of the EGR cooler cores, and a cooler-bypass position where the EGR flow is split between one of the EGR cooler cores and the bypass passage. For example, the motor 220 may be activated via a command sent from the controller to move into the single cooler position, and as a result, the motor 220 may rotate the shaft 218 by 90° clockwise (relative to the position shown in FIG. 4). In the single cooler position, the second end plate 216 is positioned such that the third opening 310 and the fourth opening 312 are aligned in a vertical manner, with the fourth opening 312 positioned at the dead space of the EGR cooler and the third opening 310 aligned with the inlet of the first EGR cooler core 206. The third poppet valve 314 and the fourth poppet valve 316 are also aligned in a vertical manner, and the third poppet valve 314 is aligned with the inlet of the second EGR cooler core 208 and the fourth poppet valve 316 is aligned with the inlet of the bypass passage 210. The first end plate 214 is arranged similarly, so that first opening 302 is aligned with the outlet of the first EGR cooler core 206, the second opening 304 is aligned with the dead space, the first poppet valve 306 is aligned with the outlet of the second EGR cooler core 208, and the second poppet valve 308 is aligned with the outlet of the bypass passage 210. In this way, in the single cooler position, the bypass passage 210 is blocked at both the inlet and the outlet via the second poppet valve 308 and the fourth poppet valve 316, the second EGR cooler core 208 is blocked at both its inlet and outlet via the first poppet valve 306 and the third poppet valve 314, and the first EGR cooler core 206 is fluidly coupled to the EGR cooler inlet 222 and the EGR cooler outlet 224 via the third opening 310 and the first opening 302.

As another example, the motor 220 may be activated via a command sent from the controller to move into the cooler-bypass position, and as a result, the motor 220 may rotate the shaft 218 by 90° counterclockwise (relative to the position shown in FIG. 4). In the cooler-bypass position, the second end plate 216 is positioned such that the third opening 310 and the fourth opening 312 are aligned in a vertical manner, with the third opening 310 aligned with the inlet of the bypass passage 210 and the fourth opening 312 aligned with the inlet of the second EGR cooler core 208. The third poppet valve 314 and the fourth poppet valve 316 are also aligned in a vertical manner, and the third poppet valve 314 is aligned with the dead space and the fourth poppet valve 316 is aligned with the inlet of the first EGR cooler core 206. The first end plate 214 is arranged similarly, so that the first opening 302 is aligned with the outlet of the bypass passage 210, the second opening 304 is aligned with the outlet of the second EGR cooler core 208, the first poppet valve 306 is aligned with the dead space, and the second poppet valve 308 is aligned with the outlet of the first EGR cooler core 206. In this way, in the cooler-bypass position, the bypass passage is open at both the inlet and the outlet via the first opening 302 and the third opening 310, the first EGR cooler core 206 is blocked at both its inlet and outlet via the second poppet valve 308 and the fourth poppet valve 316, and the second EGR cooler core 208 is open at both ends (e.g., fluidly coupled to the EGR cooler inlet 222 and the EGR cooler outlet 224) via the second opening 304 and the fourth opening 312.

While the rotary valve 212 is illustrated and described herein as including poppet valves to seal the various passages/cores of the EGR cooler 202, in other examples, the rotary valve may include other mechanisms to seal the bypass passage and the EGR cooler core(s), such as a flat surface of each end plate configured to be in face-sharing contact with the inlet or outlet of the bypass passage or EGR cooler core(s), or the bypass and EGR cooler cores may be sealed by another sealing mechanism, such as a gasket, on the end plate.

Figure 5A:
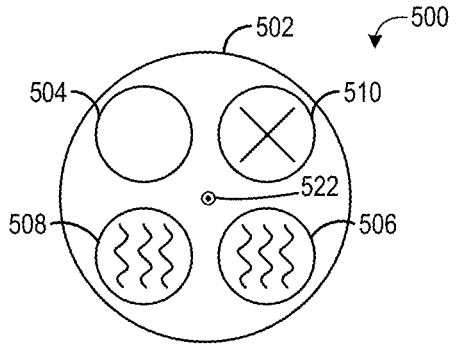
FIGS. 5A and 5B schematically show fluidic couplings between an inlet of the EGR cooler and the bypass passage and the cooler cores of the EGR cooler when an end plate of the rotary valve is rotated to different positions.
Figure 5B:
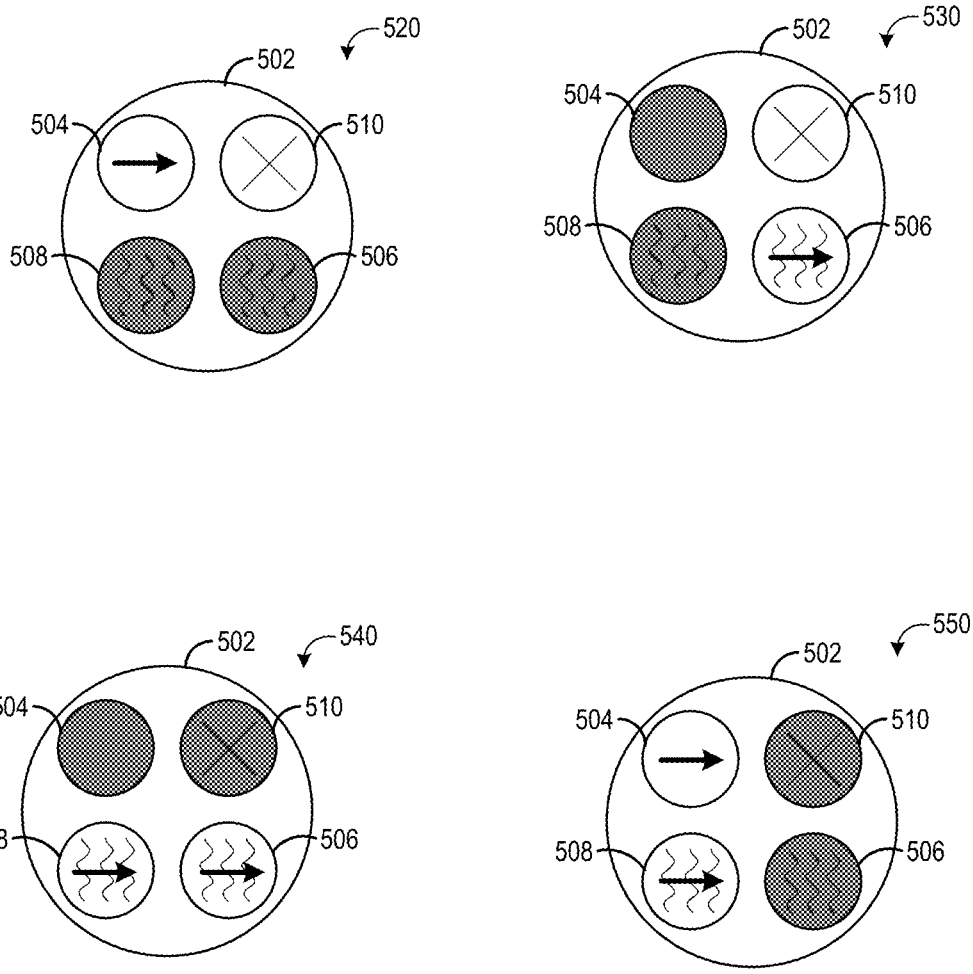
Figure 6:
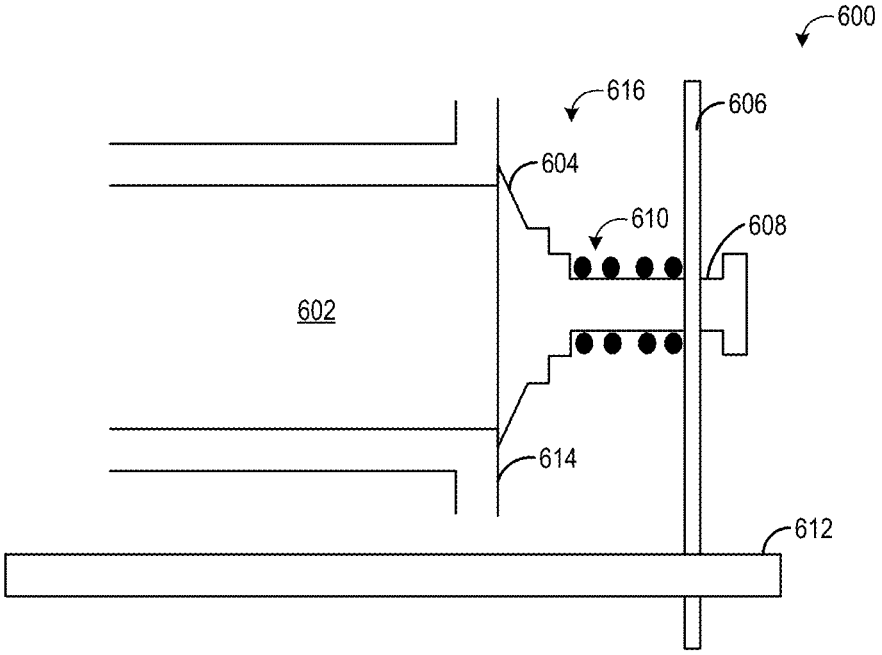
FIG. 6 schematically shows an example poppet valve of the rotary valve in contact with a passage of the EGR cooler.

FIG. 5A shows a schematic view of the inlets/outlets of the bypass passage, the first cooler core, and the second cooler core relative to the end plates, and FIG. 5B schematically shows how the various inlets/outlets are blocked or maintained open in the four positions of the end plates of the rotary valve, and thus the corresponding flow paths of the EGR cooler. In this manner, FIGS. 5A and 5B may show a schematic depiction of an inlet plate 502 of the EGR cooler housing 204, which may include openings that define the inlets of the bypass passage, the first EGR cooler core, and the second EGR cooler core. The second end plate of the rotary valve may be positioned intermediate the inlet plate 502 and the second EGR chamber 228. As shown in FIG. 5B, the openings in the inlet plate 502 may be blocked or may remain open depending on the position of the rotary valve, which may be placed in a bypass position 520, a single cooler position 530, a dual-cooler position 540, or a cooler-bypass position 550.

As shown in FIG. 5A, the inlet plate 502 may include openings that define and fluidly couple a bypass passage inlet 504, a first EGR cooler core inlet 506, and a second EGR cooler core inlet 508. Also shown in FIG. 5A is a closed-off portion 510, where no internal structure of the EGR cooler may be present. The rotary valve may rotate around a central longitudinal axis 522, which may be positioned at a vertical and lateral midpoint of the inlet plate 502.

As shown in FIG. 5B, when the rotary valve is in the bypass position 520, the bypass passage inlet 504 may be open and EGR may flow through the bypass passage, which is shown schematically with the arrow, while the first and second EGR cooler cores are sealed by the first and second poppet valves, as indicated schematically by the first EGR cooler core inlet 506 and the second first EGR cooler core inlet 508 being shown in gray. In this way, the first poppet valve may be sealingly engaged with the first cooler core inlet 506, preventing any of the recirculating exhaust gas from flowing through the first EGR cooler core. The second poppet valve may be sealingly engaged with the second cooler core inlet 508, preventing any of the recirculating exhaust gas from flowing in the second EGR cooler core.

When the rotary valve is in the single-cooler position 530, the first EGR cooler core inlet 506 may be open, thereby allowing EGR to flow through the first EGR cooler core, while the bypass passage inlet 504 and the second EGR cooler core inlet 508 are both blocked by poppet valves of the rotary valve. In this way, exhaust gas may flow through the first EGR cooler core, a poppet valve may be sealingly engaged with the second EGR cooler core inlet 508, preventing exhaust gas from flowing through the second EGR cooler core, and another poppet valve is sealingly coupled to the bypass passage inlet 504, preventing exhaust gas from flowing through the bypass passage.

When the rotary valve is in the dual cooler position 540, the first EGR cooler core inlet 506 is open, allowing exhaust gas to flow through the first EGR cooler core inlet 506 and into the first EGR cooler core. The second EGR cooler core inlet 508 is also open, allowing exhaust gas to flow through the second EGR cooler core. One of the poppet valves may be sealingly engaged with the bypass passage inlet 504 such that no exhaust gas may flow through the bypass passage. The other poppet valve may not be engaged because there may be no passage or EGR cooler core for the other poppet valve to engage with.

When the rotary valve is in the bypass-cooler position 550, the second EGR cooler core inlet 508 and the bypass passage inlet 504 are each open, such that exhaust gas may flow into and then out of the second EGR cooler core and the bypass passage. One of the poppet valves may seal the first EGR cooler core inlet 506 such that substantially no exhaust gas may flow through the first EGR cooler core inlet or the first EGR cooler core.

FIG. 6 shows a schematic view 600 of a portion of a passage 602 and a rotary valve, such as rotary valve 212, comprising an end plate 606, a poppet valve 616 with a spring 610, and a rotary valve shaft 612.

The passage 602 may be a bypass passage, the first EGR cooler core, or the second EGR cooler core, as the bypass passage, first EGR cooler core, and second EGR cooler core may engage with the rotary valve in substantially the same or identical ways. The end plate 606 may be the first end plate, but the first end plate and the second end plate may have structures which are substantially identical, but mirrored across a plane that is perpendicular to the axis of rotary valve shaft 612. For example, the second end plate may include similar poppet valves to the poppet valve 616 shown in FIG. 6 that may be configured to seal/block the inlets of the bypass passage, the first EGR cooler core, and the second EGR cooler core.

The passage 602 extends longitudinally towards the end plate 606. The passage may comprise a cylindrical tube through which exhaust may flow. The passage may terminate at an outlet plate 614 that extends radially outward from the walls of the passage. In some examples, the outlet plate 614 may include openings for and be coupled to each of the bypass passage, the first EGR cooler core, and the second EGR cooler core, and may have a shape and size that match the inner dimensions of the EGR cooler housing. The EGR cooler may include a similar plate at the inlet end, e.g., an inlet plate as described above with respect to FIGS. 5A and 5B.

The poppet valve 616 may sealingly engage with the plate 614, preventing exhaust gas from flowing into or out of the passage 602. The poppet valve 616 may comprise a valve head 604 coupled to a valve stem 608. The valve stem 608 may comprise a central shaft, engaged with the end plate 606 to secure the valve stem 608 in position and to rotate the poppet valve 616 about the central longitudinal axis (e.g., the shaft 612). The valve head 604 may be seated on the plate 614 so that the valve head 604 extends across and seals the passage 602, with the edges of the valve head 604 in face-sharing contact with the plate 614.

A spring 610 may be coupled to the valve stem 608, and wrapped around a portion of the outer circumferential area of the valve stem 608. The spring 610 may be coupled to the valve head 604 such that the spring 610 may push the valve head longitudinally towards the plate 614, thereby maintaining the valve head 604 in contact with the plate 614.

The end plate 606 and coupled components (e.g. the poppet valve and spring) may rotate around the shaft 612. The rotary valve shaft 612 may extend longitudinally, perpendicular to the end plate 606. The rotary valve shaft 612 may be engaged with a second end plate (not pictured in FIG. 6) having a substantially similar structure to the first end plate 606 pictured in FIG. 6.

FIGS. 7A and 7B show a flow chart illustrating a method 700 for controlling EGR flow in an EGR cooler, such as EGR cooler 202, via control of an EGR cooler rotary valve, such as rotary valve 212. Instructions for carrying out method 700 and the rest of the methods included herein may be executed by a controller (e.g., controller 12 of FIG. 1) based on instructions stored on a memory of the controller and in conjunction with signals received from sensors of the engine system, such as the sensors described above with reference to FIG. 1. The controller may employ engine actuators of the engine system to adjust engine operation according to the methods described below.

At 702, the method 700 includes determining operating parameters. The operating parameters may include engine load, engine speed, engine temperature, EGR valve position, and other operating parameters. At 704, method 700 includes determining if EGR is flowing. EGR may be determined to be flowing based on the determined operating parameters (e.g., engine speed and load, engine temperature), based on a current position of the EGR valve (e.g., EGR valve 142 of FIG. 1), and/or based on a commanded position of the EGR valve. For example, during certain engine load conditions (such as very low load or high/maximum load) or during engine warm-up conditions, EGR flow may not be desired and thus the EGR valve may be closed and EGR may not be flowing. If EGR is not flowing, the method 700 proceeds to 706 to maintain the EGR cooler rotary valve at its current position, and the method returns. Because EGR is not flowing, no EGR is flowing through the EGR cooler and thus the position of the EGR cooler rotary valve is moot. If EGR is flowing, the method proceeds to 708 to determine if EGR cooler bypass conditions have been met. The EGR cooler bypass conditions may include operating conditions where EGR cooling via the EGR cooler is not desired, such as when the engine is still warming up and/or when catalyst light-off temperature has not been reached.

If at 708 the EGR cooler bypass conditions have been met, the method proceeds to 710, in which the EGR cooler rotary valve is adjusted or maintained to be in the bypass position. The bypass position of the rotary valve is shown in FIG. 4, and may also be the bypass position 520 of FIG. 5B. As explained above, the bypass position of the rotary valve may include a position where the bypass passage of the EGR cooler is open and fluidly coupled to the EGR cooler inlet and outlet, so that the EGR may flow through the bypass passage. The bypass position further includes the two cooler core flow paths of the EGR cooler (e.g., the first EGR cooler core 206 and the second EGR cooler 208) being blocked at both the respective inlets and outlets by poppet valves of the rotary valve, so that all EGR flowing through the EGR passage upstream of the EGR cooler is routed through the bypass passage, and none of the EGR flows through a cooler core. Thus, as indicated at 712, in the bypass position of the rotary valve, EGR flows only through the bypass passage, bypassing both EGR cooler core flow paths. The method then returns.

Figure 9:
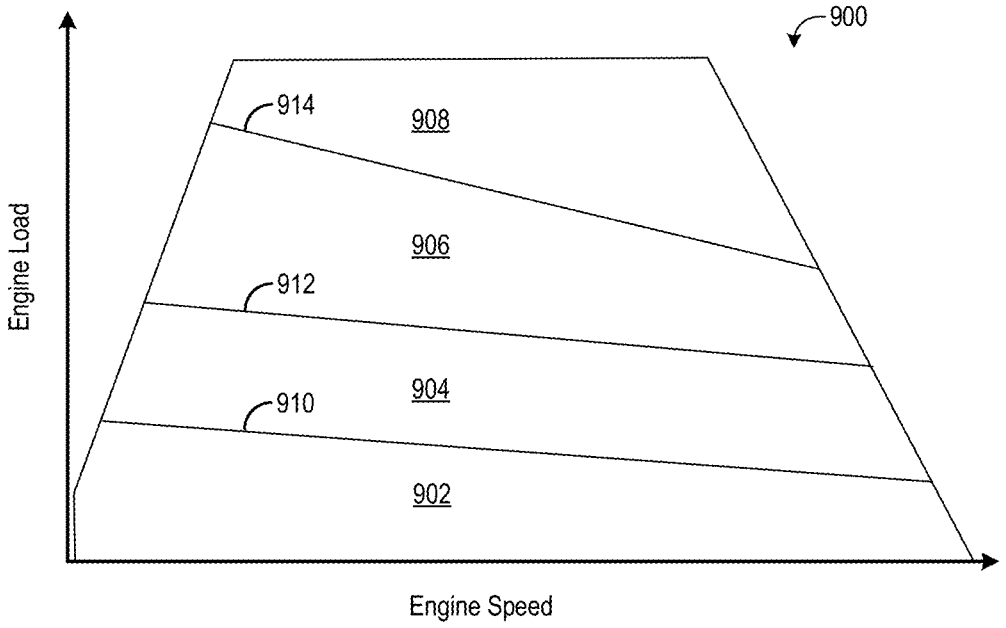
FIG. 9 shows a graph illustrating example EGR cooler modes as a function of engine speed and load.

If the EGR cooler bypass conditions have not been met at 708, the method proceeds to 714 to determine if the engine speed and engine load are in a first speed-load region. The first speed-load region may include high engine loads across all engine speeds (e.g., 90% maximum load or greater) and at higher engine speeds, also include mid-to-high engine loads (e.g., 65 or 75% maximum load or greater). An example speed-load map including four regions for controlling the four rotary valve positions described herein is shown in FIG. 9 and described in more detail below. The first region may correspond to the fourth mode 908 of FIG. 9. If the engine speed and load are within the first region, the method proceeds to 716 to adjust (or maintain) the EGR cooler rotary valve to a dual-core position, such as the position of the rotary valve shown in FIG. 3 and the dual-core position 540 of FIG. 5B. In the dual-core position, the rotary valve may allow EGR flow through both EGR cooler core flow paths, as indicated at 718, while the bypass passage is blocked. The rotary valve may be moved into the dual-core position during conditions where EGR cooling is desired (e.g., after engine warm-up) and engine load is high (e.g., above a threshold load such as above 65% maximum load, depending on engine speed). During high load conditions, a relatively large amount of exhaust gas may be produced and a relatively high level of EGR may be directed to the engine. As such, sufficient EGR is present to allow EGR flow through both EGR cooler core flow paths. Method 700 then returns.

It is to be appreciated that while method 700 as described herein monitors engine speed and load and adjusts the position of the rotary valve to the dual-core position in response to engine load increasing above a threshold load for a given engine speed, other engine operating parameters may be monitored in addition or alternative to engine load. For example, an amount or rate of EGR flowing into the EGR cooler may be monitored, based on a position of the EGR valve, commanded EGR rate (which may be based on engine speed and load), and/or engine fueling parameters (e.g., fuel injection amounts). If the EGR amount or rate exceeds a threshold, the rotary valve may be adjusted to the dual-core position.

Returning to 714, if the engine speed and load are not in the first region, the method proceeds to 720 (shown in FIG. 7B) to determine if engine speed and load are within a second speed-load region. The second speed-load region may include medium engine loads, such as engine loads between 40% and 60-90% load, depending on engine speed. The second speed-load region may correspond to the third mode 906 of FIG. 9, which is explained below.

If the engine is operating in the second speed-load region, the method continues to 722, which includes adjusting (or maintaining) the EGR cooler rotary valve into the single-core position. The single-core position may be the single-core position 530 of FIG. 5B. When the rotary valve is in the single-core position, the bypass passage and one of the EGR cooler core flow paths (e.g., the second EGR cooler core 208) are blocked, and the other EGR cooler core flow path (e.g., the first EGR cooler core 206) is open. At 724, the recirculated exhaust gas flows only though a single EGR cooler core flow path (and not through the other EGR cooler core flow path or the bypass passage), due to the rotary valve being in the single-core position. During this medium load region, differential pressure may be relatively high (e.g., 20 kPa above intake pressure) and the EGR may be flowed at a relatively high velocity by restricting the EGR flow through only the single EGR cooler core flow path (e.g., rather than flowing the EGR through two EGR cooler core flow paths), which may have a smaller cross-sectional area than traditional single path EGR cooler cores (where only one cooler core with one flow path is present in the EGR cooler). By maintaining the EGR at high velocity (e.g., higher than flowing the EGR through both cooler core flow paths), EGR cooler fouling may be reduced. The method then returns.

Returning to 720, if the engine is not operating in the second speed-load region, the method proceeds to 726, which comprises adjusting (or maintaining) the EGR cooler rotary valve position to the bypass-cooler position, and at 728, exhaust gas is recirculated through a single EGR cooler core flow path and the bypass passage. The bypass-cooler position may be the bypass-cooler position 550 of FIG. 5B, and may include one of the EGR cooler core flow paths (e.g., the second EGR cooler core 208) and the bypass passage each being open while the other EGR cooler core flow path is blocked. The rotary valve may be placed into the bypass-cooler position during low to medium loads (e.g., below 50% load but above the very low load region where the EGR bypasses the cooler core flow paths) where EGR flow is relatively low and when the differential pressure is relatively low. By splitting the EGR flow between the bypass passage and one of the EGR cooler core flow paths, some cooling may be provided to the EGR. The method then returns.

FIG. 8 is a timeline 800 showing operating parameters of interest during execution of method 700. For example, timeline 800 shows modulation of flow of recirculated exhaust gas through an EGR cooler during operation of a vehicle, such as vehicle 5 of FIG. 1. Vehicle load is shown in plot 802, EGR valve position is shown in plot 806, and (commanded) EGR rotary valve position is shown in plot 810. For all of the above, the X-axis represents time, with time increasing along the X-axis from left to right. The Y-axis indicates each labeled parameter.

The Y axis for plot 802 indicates engine load, which increases continuously from bottom to top of plot 802. Curve 804 indicates the relation between load and time, in this example.

The Y axis for plot 806 indicates the value of EGR valve position. The Y value may be a position ranging continuously from closed at the bottom to open at the top. This value may correspond to the amount of exhaust gas flowing into the EGR cooler, at least during most operating conditions. Curve 808 indicates the relationship between EGR valve position and time, in this example.

The Y axis of plot 810 indicates the position of the rotary valve of the EGR cooler. The value refers to a discrete position of the rotary valve, which may be in position 1, corresponding to the bypass position; position 2, corresponding to the single-cooler position; position 3, corresponding to the dual-cooler position; or position 4, corresponding to the bypass-cooler position. Curve 812 indicates the relation between rotary valve position and time, in this example.

Five time points of interest are presented as dashed vertical lines. At time t1, the engine, which may be the engine 10 shown in FIG. 1, is turned on. At t1, the load is minimal (e.g. when the vehicle is idling following startup), the EGR valve position is closed, and the rotary valve position is in a first (bypass) position. Because the EGR valve is closed, no exhaust may flow through the EGR cooler to interact with the rotary valve.

At t2, the load is still low but is increasing (e.g., as the vehicle is launched), and due to the increased load, the EGR valve begins to open. However, the engine is still warming up and thus cooling of the EGR is not desired. As a result, the position of the rotary valve may be maintained in the first (bypass) position, allowing all of the recirculated exhaust gas to flow through the bypass passage.

At t3 the load has increased to medium load (above a first threshold T1), and the EGR valve is partially opened (e.g., 25% open) to allow exhaust gas to circulate through the EGR system. At time t3, the engine is warmed up. Accordingly, the controller, such as the controller shown in FIG. 1, may send a signal to rotate the rotary valve into the second (single-core) position, so that cooling of the EGR may be performed by flowing the EGR through a cooler core flow path of the EGR cooler. Because of the low load, the EGR may only flow through a single EGR cooler core flow path, which may increase the velocity of the EGR flow through the EGR cooler, thereby reducing EGR cooler fouling. Following t3, the rotary valve may be in the second (single-core) position, allowing exhaust gas to flow through a single EGR cooler core flow path.

Between t3 and t4, the load increases and the opening of the EGR valve increases. At t4, the load has reached and exceeds a second threshold load T2 and the opening of the EGR valve continues to increase, thereby allowing more exhaust to flow through the EGR system. To accommodate the increased volume of exhaust gas and prevent increased exhaust backpressure, the controller sends a signal to rotate the rotary valve to a third (dual-core) position, allowing all of the recirculated exhaust gas to flow through the two EGR cooler core flow paths.

Between t4 and t5, the load plateaus and then begins to decrease; the EGR valve also begins to close as the load decreases. At t5, the load has decreased to back below the first threshold, and as a result, EGR flow through both EGR cooler core flow paths is not indicated. However, a low differential pressure may be present in the EGR system, and thus the controller sends a signal to the rotary valve to rotate to the fourth (bypass-cooler) position. In this state, exhaust gas may flow through only one EGR cooler core and the bypass passage.

Thus, the position of the rotary valve may be adjusted to flow EGR through none, one, or both cooler core flow paths, based on engine speed and load, likelihood of cooler fouling, and/or other parameters. During high loads where higher levels of cooling are demanded, the EGR may be directed through two cooler core flow paths (e.g., through both EGR cooler cores). During low loads where no cooling is demanded, the EGR may be directed though only the bypass passage, to avoid cooling the EGR.

During medium loads where only moderate levels of cooling are demanded, the EGR may be directed through a single cooler core flow path (e.g., through only one EGR cooler core), and there is sufficient pressure drop over the system to flow the demanded EGR rate in this configuration. The higher velocities through the EGR cooler due to only flowing through half the normal cross section of the EGR cooler core(s) also inhibit fouling and is beneficial for medium load conditions with high soot concentrations and fouling risk. Conversely, if the soot concentrations are relatively low and even more moderate levels of cooling are demanded, EGR may be directed through one cooler core flow path and the bypass passage. This may provide an even lower level of cooling than flowing all the EGR through one cooler core flow path and be more appropriate for the lower end of the low/medium load regime where having sufficient pressure drop over the system to flow EGR is also an issue.

FIG. 9 is a graph 900 showing engine speed-load regions (also referred to as operation modes) that may be used to determine the position of the rotary valve, such as during execution of method 700. For example, graph 900 may be stored in memory of a controller (e.g., controller 12) and accessed to determine the current speed-load region of operation for controlling the rotary valve. The X-axis represents engine speed, with engine speed increasing along the X-axis from left to right. The Y axis for graph 900 indicates engine load, which increases continuously from bottom to top of plot 900.

Four operation modes are presented, which may be discrete operation modes resulting from the four positions of the rotary valve. These positions may be influenced by continuous values along the X and Y axes, corresponding to values of engine load and engine speed, respectively.

A first mode 902 corresponds to the bypass position of the rotary valve, in which EGR flows only through the bypass passage. In the first mode 902, the engine, which may be the engine 10 shown in FIG. 1, is operated with minimal load (e.g. below 20-30% maximum engine load, such as when the vehicle is idling). The engine speed may range from low to high speed. A first threshold 910 may define the boundary between the first mode 902 and a second mode 904. The first threshold 910 may decrease with increasing engine speed (e.g., with a negative slope). At lower engine speeds, the engine load for shifting to the second mode 904 may be higher than at higher engine speeds. For example, at an engine speed of 800 RPMs, the threshold engine load for switching to the second mode 904 may be higher than the threshold engine load for switching to the second mode 904 at 3000 RPMs.

The second mode 904 corresponds to the bypass-cooler mode, in which EGR flows through the bypass passage and an EGR cooler core flow path. In the second mode 904, the engine operates with low to medium loads (e.g., 30%-50% load), and the engine speed may be low to high. When load increases above the first threshold 910, the controller may send a signal to rotate the rotary valve into the bypass-cooler operation mode. A second threshold 912 may define a boundary between the second mode 904 and a third mode 906. The second threshold 912 may also decrease with increasing engine speed.

The third mode 906 corresponds to the single-core mode. When engine load increases past the second threshold 912, the controller may send a signal to rotate the rotary valve into single-core position, so that cooling of the EGR may be performed by flowing the EGR through one cooler core flow path of the EGR cooler only. A third threshold 914 may define a boundary between the third mode 906 and a fourth mode 908, and the third threshold 914 may decrease with increasing engine speed. The third threshold 914 may have a negative slope that is steeper than the slopes of the first threshold and second threshold. When engine load increases above the third threshold 914, the rotary valve may be operated/moved according to the fourth mode 908, which corresponds to the dual-core position, allowing exhaust gas to flow through two EGR cooler core flow paths.

Thus, graph 900 illustrates four different modes for controlling the rotary valve and flow of EGR though the EGR cooler. The four modes correspond to four regions of a speed-load plot that may be stored in memory of the controller. During engine operation, current engine speed and engine load may be entered as input to the speed-load plot, and based on the speed-load plot, the current region (or mode) of engine operation may be determined. The rotary valve may be controlled accordingly. For example, the rotary valve may be moved from the bypass position to the bypass-cooler position when engine speed and/or load increase from the first region (e.g., operation in the first mode 902) to the second region (e.g., operation in the second mode 904). The rotary valve may be moved from the bypass-cooler position to the single-core position when engine speed and/or load increase from the second region (e.g., operation in the second mode 904) to the third region (e.g., operation in the third mode 906). The rotary valve may be moved from the single-core position to the dual-core position when engine speed and/or load increase from the third region (e.g., operation in the third mode 906) to the fourth region (e.g., operation in the fourth mode 908).

In this way, an EGR rotary valve positioned in an EGR cooler may be adjusted to one of four positions in order to direct EGR flow through a bypass passage (e.g., bypassing cooler cores of the EGR cooler), through a single cooler core flow path of the EGR cooler, through two cooler core flow paths of the EGR cooler, or through both the bypass passage and one of the cooler core flow paths of the EGR cooler. By providing two EGR cooler core flow paths and the rotary valve described herein, the velocity of the EGR through a cooler core flow path of the EGR cooler during low EGR flow conditions may be increased by directing the EGR through only the single cooler core flow path, thereby lowering the risk of fouling in the cooler core. During higher flow conditions, the EGR may be directed through both cooler core flow paths. Further, during conditions where cooling of the EGR is not indicated, the EGR may be directed through the bypass passage and not through the cooler core(s). Additionally, during lower flow conditions where differential pressure across the EGR cooler is low, the EGR flow may be split between one of the cooler core flow paths and the bypass passage. In doing so, the EGR may be cooled as indicated, when EGR cooler fouling is not indicated. Further, the rotary valve described herein may include mechanisms (e.g., poppet valves) to seal the bypass passage or the cooler core(s) on both the upstream and the downstream ends, which may prevent inadvertent admission of EGR into any sealed passages/cores.

The technical effect of controlling a valve in an EGR cooler is to selectively block or allow flow through a bypass passage, a first EGR cooler core, and a second EGR cooler core, as desired, which may prevent EGR cooler fouling while providing sufficient/demanded EGR cooling Another technical effect of the disclosure is bidirectional sealing of the bypass passage, first cooler core, and second cooler core, which may reduce cooler fouling, maintain desired EGR flow to the exhaust intake, and produce desired cooling of the EGR. By sealing both the upstream and downstream ends of the bypass passage and cooler core(s)

when requested, exhaust may be prevented from entering into the bypass passage and the first and second cooler cores.

The structure of the EGR cooler comprising two end plates may allow for EGR to enter the EGR cooler through a central upstream inlet and exit the EGR cooler through a central downstream exit. Thus the exhaust gas may be split within the EGR cooler to traverse the appropriate passage (e.g. the bypass passage, the first EGR cooler core, or the second EGR cooler core), but combine downstream to flow through one pipe. Thus, the portion of the exhaust system which comprises multiple pipes may be minimized, and the expense and packaging needs of having multiple pipes may be avoided.

Utilizing two end plates to seal the EGR cooler cores and the bypass passage may allow for a reduction in costly and bulky actuators. One actuator may be used to rotate the two endplates, eliminating the need for a valve actuator for each of the valves of the bypass passage and the two EGR cooler cores. By using passive sealing mechanisms, (e.g. poppet valves sealingly engaged with the inlet and outlet of the bypass passage or EGR cooler cores, or by a flat endplate in fluidically-sealing, face-sharing contact with the inlet and outlet of the bypass passage or EGR cooler core), the passage may be sealed without the need for an actuator to change their state, further reducing the number of actuators needed.

The disclosure also provides support for a method, comprising: flowing exhaust gas recirculation (EGR) through an EGR cooler positioned in an EGR passage, the EGR cooler comprising a bypass passage, a first cooler core flow path, and a second cooler core flow path, and adjusting a valve of the EGR cooler to selectively block flow of the EGR through the bypass passage, the first cooler core flow path, and the second cooler core flow path. In a first example of the method, the valve of the EGR cooler is a rotary valve positioned at least partially within a housing of the EGR valve, and wherein flowing EGR through the EGR cooler comprises opening an EGR valve positioned in the EGR passage upstream or downstream of the EGR cooler. In a second example of the method, optionally including the first example, adjusting the valve of the EGR cooler to selectively block flow of the EGR through the bypass passage, the first cooler core flow path, and the second cooler core flow path comprises, responsive to a first condition, adjusting the valve into a first position where the first cooler core flow path and the second cooler core flow path are each blocked, and flowing the EGR through the bypass passage and not through the first cooler core flow path or the second cooler core flow path. In a third example of the method, optionally including the first and/or second examples, adjusting the valve of the EGR cooler to selectively block flow of the EGR through the bypass passage, the first cooler core flow path, and the second cooler core flow path comprises, responsive to a second condition, adjusting the valve into a second position where the second cooler core flow path and the bypass passage are each blocked, and flowing the EGR through the first cooler core flow path and not through the second cooler core flow path or the bypass passage. In a fourth example of the method, optionally including one or more or each of the first through third examples, adjusting the valve of the EGR cooler to selectively block flow of the EGR through the bypass passage, the first cooler core flow path, and the second cooler core flow path comprises, responsive to a third condition, adjusting the valve into a third position where the bypass passage is blocked, and flowing the EGR through the first cooler core flow path and the second cooler core flow path and not through the bypass passage. In a fifth example of the method, optionally including one or more or each of the first through fourth examples, adjusting the valve of the EGR cooler to selectively block flow of the EGR through the bypass passage, the first cooler core flow path, and the second cooler core flow path comprises, responsive to a fourth condition, adjusting the valve into a fourth position where the first cooler core flow path is blocked, and flowing the EGR through the second cooler core flow path and the bypass passage and not through the first cooler core flow path. In a sixth example of the method, optionally including one or more or each of the first through fifth examples, the valve includes a first end plate and a second end plate coupled via a shaft, and wherein adjusting the valve of the EGR cooler to selectively block flow of the EGR through the bypass passage, the first cooler core flow path, and the second cooler core flow path comprises activating a motor coupled to the shaft to rotate the shaft, the first end plate, and the second end plate. In a seventh example of the method, optionally including one or more or each of the first through sixth examples, the first cooler core flow path comprises a first cooler core of the EGR cooler and the second cooler core flow path comprises a second cooler core of the EGR cooler, and wherein adjusting the valve of the EGR cooler to selectively block flow of the EGR through the bypass passage, the first cooler core flow path, and the second cooler core flow path comprises adjusting the valve of the EGR cooler to selectively block flow of the EGR through the bypass passage, the first cooler core, and the second cooler core.

The disclosure also provides support for a method for an engine system including an exhaust gas recirculation (EGR) cooler, comprising: during low EGR flow conditions where EGR cooling is demanded, directing EGR through only a first cooler core flow path of the EGR cooler and not through a second cooler core flow path of the EGR cooler, via a valve in a first position, and during high EGR flow conditions, directing EGR through both the first cooler core flow path and the second cooler core flow path, via the valve in a second position, where the valve, in the first position, seals the second cooler core flow path at both an upstream end and a downstream end of the second cooler core flow path. In a first example of the method, the method further comprises: during low EGR flow conditions where EGR cooling is not demanded, directing EGR through a bypass passage of the EGR cooler and not through the first cooler core flow path or the second cooler core flow path, via the valve in a third position. In a second example of the method, optionally including the first example, the method further comprises: during low differential pressure conditions, directing EGR through both the bypass passage and the second cooler core flow path and not through the first cooler core flow path, via the valve in a fourth position. In a third example of the method, optionally including the first and/or second examples, the valve is a rotary valve positioned at least partially within a housing of the EGR cooler, and further comprising moving the rotary valve to the first position, the second position, the third position, and/or the fourth position by rotating a motor-driven shaft coupling a first end plate of the rotary valve to a second end plate of the rotary valve. In a fourth example of the method, optionally including one or more or each of the first through third examples, the first cooler core flow path comprises a flow path through a first cooler core of the EGR cooler and the second cooler core flow path comprises a flow path through a second cooler core of the EGR cooler, wherein the rotary valve, in the first position, seals the second cooler core at both the upstream end and the downstream end of the second cooler core by positioning a first poppet valve of the first end plate in face-sharing contact with an outlet of the second cooler core and a second poppet valve of the second end plate in face-sharing contact with an inlet of the second cooler core, wherein the first end plate further includes a first opening and the second end plate further includes a second opening, and in the first position of the rotary valve, the first opening is aligned with an outlet of the first cooler core and the second opening is aligned with an inlet of the first cooler core. In a fifth example of the method, optionally including one or more or each of the first through fourth examples, the method further comprises: adjusting an amount of EGR flowing into the EGR cooler by adjusting an EGR valve positioned upstream or downstream of the EGR cooler, and wherein the low flow EGR conditions include engine load being below a threshold load and wherein the high flow EGR conditions include engine load being above the threshold load.

The disclosure also provides support for a system, comprising: an exhaust gas recirculation (EGR) cooler positioned in an EGR passage coupled between an exhaust manifold and an intake manifold of an engine, the EGR cooler including: a housing, a first cooler core, a second cooler core, a bypass passage, each of the first cooler core, the second cooler core, the bypass passage positioned in the housing, and a rotary valve at least partially positioned in the housing, the rotary valve including a first end plate positioned in an outlet chamber of the EGR cooler and a second end plate positioned in an intake chamber of the EGR cooler, the first end plate and second end plate coupled to a motor via a common shaft and movable, via the motor, to four positions in order to block or allow flow of EGR through the first cooler core, the second cooler core, and the bypass passage. In a first example of the system, each of the first cooler core and the second cooler core includes a plurality of gas-flowing passages in thermal contact with a heat-transfer medium. In a second example of the system, optionally including the first example, the first cooler core includes a first outlet, the second cooler core includes a second outlet, and the bypass passage includes a third outlet, and the first end plate of the rotary valve includes a first opening, a second opening, a first poppet valve, and a second poppet valve, wherein the rotary valve is movable, via the motor, to selectively fluidly couple an outlet of the EGR cooler to the first outlet, the second outlet, and/or the third outlet via the first opening and the second opening and to selectively seal the first outlet, the second outlet, and/or the third outlet via the first poppet valve and the second poppet valve. In a third example of the system, optionally including the first and/or second examples, the first cooler core includes a first inlet, the second cooler core includes a second inlet, and the bypass passage includes a third inlet, and the second end plate of the rotary valve includes a third opening, a fourth opening, a third poppet valve, and a fourth poppet valve, wherein the rotary valve is movable, via the motor, to selectively fluidly couple an inlet of the EGR cooler to the first inlet, the second inlet, and/or the third inlet via the third opening and the fourth opening and to selectively seal the first inlet, the second inlet, and/or the third inlet via the third poppet valve and the fourth poppet valve. In a fourth example of the system, optionally including one or more or each of the first through third examples, the system further comprises: a controller storing instructions in non-transitory memory executable to: responsive to a first condition, activate the motor to move the rotary valve into a first position where the first inlet and the first outlet are each sealed, the second inlet and the second outlet are each sealed, and the third inlet is fluidly coupled to the inlet of the EGR cooler and the third outlet is fluidly coupled to the outlet of the EGR cooler, responsive to a second condition, activate the motor to move the rotary valve into a second position where the first inlet is fluidly coupled to the inlet of the EGR cooler and the first outlet is fluidly coupled to the outlet of the EGR cooler, the second inlet and the second outlet are each sealed, and the third inlet and the third outlet are each sealed, responsive to a third condition, activate the motor to move the rotary valve into a third position where the first inlet is fluidly coupled to the inlet of the EGR cooler and the first outlet is fluidly coupled to the outlet of the EGR cooler, the second inlet is fluidly coupled to the inlet of the EGR cooler and the second outlet is fluidly coupled to the outlet of the EGR cooler, and the third inlet and the third outlet are each sealed, and responsive to a fourth condition, activate the motor to move the rotary valve into a fourth position where the second inlet and the third inlet are each fluidly coupled to the inlet of the EGR cooler and the second outlet and the third outlet are each fluidly coupled to the outlet of the EGR cooler, and the first inlet and the first outlet are each sealed. In a fifth example of the system, optionally including one or more or each of the first through fourth examples, the system further comprises: an EGR valve positioned in the EGR passage, and wherein the instructions are further executable to adjust a position of the EGR valve to control an amount of EGR flowing through the EGR passage and the EGR cooler.

FIGS. 1-4 and 6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

flowing exhaust gas recirculation (EGR) through an EGR cooler positioned in an EGR passage by opening an EGR valve positioned in the EGR passage upstream or downstream of the EGR cooler, the EGR cooler comprising a bypass passage, a first cooler core flow path, and a second cooler core flow path; and adjusting a rotary valve of the EGR cooler to selectively block flow of the EGR through the bypass passage, the first cooler core flow path, and the second cooler core flow path, the rotary valve positioned at least partially within a housing of the EGR cooler.

2. The method of claim 1, wherein adjusting the rotary valve of the EGR cooler to selectively block flow of the EGR through the bypass passage, the first cooler core flow path, and the second cooler core flow path comprises, responsive to a first condition, adjusting the rotary valve into a first position where the first cooler core flow path and the second cooler core flow path are each blocked; and flowing the EGR through the bypass passage and not through the first cooler core flow path or the second cooler core flow path.

3. The method of claim 1, wherein adjusting the rotary valve of the EGR cooler to selectively block flow of the EGR through the bypass passage, the first cooler core flow path, and the second cooler core flow path comprises, responsive to a second condition, adjusting the rotary valve into a second position where the second cooler core flow path and the bypass passage are each blocked; and flowing the EGR through the first cooler core flow path and not through the second cooler core flow path or the bypass passage.

4. The method of claim 1, wherein adjusting the rotary valve of the EGR cooler to selectively block flow of the EGR through the bypass passage, the first cooler core flow path, and the second cooler core flow path comprises, responsive to a third condition, adjusting the rotary valve into a third position where the bypass passage is blocked; and flowing the EGR through the first cooler core flow path and the second cooler core flow path and not through the bypass passage.

5. The method of claim 1, wherein adjusting the rotary valve of the EGR cooler to selectively block flow of the EGR through the bypass passage, the first cooler core flow path, and the second cooler core flow path comprises, responsive to a fourth condition, adjusting the rotary valve into a fourth position where the first cooler core flow path is blocked; and flowing the EGR through the second cooler core flow path and the bypass passage and not through the first cooler core flow path.

6. The method of claim 1, wherein the rotary valve includes a first end plate and a second end plate coupled via a shaft, and wherein adjusting the rotary valve of the EGR cooler to selectively block flow of the EGR through the bypass passage, the first cooler core flow path, and the second cooler core flow path comprises activating a motor coupled to the shaft to rotate the shaft, the first end plate, and the second end plate.

7. The method of claim 1, wherein the first cooler core flow path comprises a first cooler core of the EGR cooler and the second cooler core flow path comprises a second cooler core of the EGR cooler; and wherein adjusting the rotary valve of the EGR cooler to selectively block flow of the EGR through the bypass passage, the first cooler core flow path, and the second cooler core flow path comprises adjusting the rotary valve of the EGR cooler to selectively block flow of the EGR through the bypass passage, the first cooler core, and the second cooler core.

8. A method for an engine system including an exhaust gas recirculation (EGR) cooler, comprising:

during low EGR flow conditions where EGR cooling is demanded, directing EGR through only a first cooler core flow path of the EGR cooler and not through a second cooler core flow path of the EGR cooler, via a valve in a first position; and during high EGR flow conditions, directing EGR through both the first cooler core flow path and the second cooler core flow path, via the valve in a second position, where the valve, in the first position, seals the second cooler core flow path at both an upstream end and a downstream end of the second cooler core flow path.

9. The method of claim 8, further comprising during low EGR flow conditions where EGR cooling is not demanded, directing EGR through a bypass passage of the EGR cooler and not through the first cooler core flow path or the second cooler core flow path, via the valve in a third position.

10. The method of claim 9, further comprising during low differential pressure conditions, directing EGR through both the bypass passage and the second cooler core flow path and not through the first cooler core flow path, via the valve in a fourth position.

11. The method of claim 10, wherein the valve is a rotary valve positioned at least partially within a housing of the EGR cooler, and further comprising moving the rotary valve to the first position, the second position, the third position, and/or the fourth position by rotating a motor-driven shaft coupling a first end plate of the rotary valve to a second end plate of the rotary valve.

12. The method of claim 11, wherein the first cooler core flow path comprises a flow path through a first cooler core of the EGR cooler and the second cooler core flow path comprises a flow path through a second cooler core of the EGR cooler, wherein the rotary valve, in the first position, seals the second cooler core at both the upstream end and the downstream end of the second cooler core by positioning a first poppet valve of the first end plate in face-sharing contact with an outlet of the second cooler core and a second poppet valve of the second end plate in face-sharing contact with an inlet of the second cooler core, wherein the first end plate further includes a first opening and the second end plate further includes a second opening, and in the first position of the rotary valve, the first opening is aligned with an outlet of the first cooler core and the second opening is aligned with an inlet of the first cooler core.

13. The method of claim 11, further comprising adjusting an amount of EGR flowing into the EGR cooler by adjusting an EGR valve positioned upstream or downstream of the EGR cooler, and wherein the low flow EGR conditions include engine load being below a threshold load and wherein the high flow EGR conditions include engine load being above the threshold load.

14. A system, comprising:

an exhaust gas recirculation (EGR) cooler positioned in an EGR passage coupled between an exhaust manifold and an intake manifold of an engine, the EGR cooler including:

a housing;

a first cooler core;

a second cooler core;

a bypass passage, each of the first cooler core, the second cooler core, the bypass passage positioned in the housing; and a rotary valve at least partially positioned in the housing, the rotary valve including a first end plate positioned in an outlet chamber of the EGR cooler and a second end plate positioned in an intake chamber of the EGR cooler, the first end plate and second end plate coupled to a motor via a common shaft and movable, via the motor, to four positions in order to block or allow flow of EGR through the first cooler core, the second cooler core, and the bypass passage.

15. The system of claim 14, wherein each of the first cooler core and the second cooler core includes a plurality of gas-flowing passages in thermal contact with a heat-transfer medium.

16. The system of claim 14, wherein the first cooler core includes a first outlet, the second cooler core includes a second outlet, and the bypass passage includes a third outlet, and the first end plate of the rotary valve includes a first opening, a second opening, a first poppet valve, and a second poppet valve, wherein the rotary valve is movable, via the motor, to selectively fluidly couple an outlet of the EGR cooler to the first outlet, the second outlet, and/or the third outlet via the first opening and the second opening and to selectively seal the first outlet, the second outlet, and/or the third outlet via the first poppet valve and the second poppet valve.

17. The system of claim 16, wherein the first cooler core includes a first inlet, the second cooler core includes a second inlet, and the bypass passage includes a third inlet, and the second end plate of the rotary valve includes a third opening, a fourth opening, a third poppet valve, and a fourth poppet valve, wherein the rotary valve is movable, via the motor, to selectively fluidly couple an inlet of the EGR cooler to the first inlet, the second inlet, and/or the third inlet via the third opening and the fourth opening and to selectively seal the first inlet, the second inlet, and/or the third inlet via the third poppet valve and the fourth poppet valve.

18. The system of claim 17, further comprising a controller storing instructions in non-transitory memory executable to:

responsive to a first condition, activate the motor to move the rotary valve into a first position where the first inlet and the first outlet are each sealed, the second inlet and the second outlet are each sealed, and the third inlet is fluidly coupled to the inlet of the EGR cooler and the third outlet is fluidly coupled to the outlet of the EGR cooler;

responsive to a second condition, activate the motor to move the rotary valve into a second position where the first inlet is fluidly coupled to the inlet of the EGR cooler and the first outlet is fluidly coupled to the outlet of the EGR cooler, the second inlet and the second outlet are each sealed, and the third inlet and the third outlet are each sealed;

responsive to a third condition, activate the motor to move the rotary valve into a third position where the first inlet is fluidly coupled to the inlet of the EGR cooler and the first outlet is fluidly coupled to the outlet of the EGR cooler, the second inlet is fluidly coupled to the inlet of the EGR cooler and the second outlet is fluidly coupled to the outlet of the EGR cooler, and the third inlet and the third outlet are each sealed; and responsive to a fourth condition, activate the motor to move the rotary valve into a fourth position where the second inlet and the third inlet are each fluidly coupled to the inlet of the EGR cooler and the second outlet and the third outlet are each fluidly coupled to the outlet of the EGR cooler, and the first inlet and the first outlet are each sealed.

19. The system of claim 18, further comprising an EGR valve positioned in the EGR passage, and wherein the instructions are further executable to adjust a position of the EGR valve to control an amount of EGR flowing through the EGR passage and the EGR cooler.

* * * * *